US011155110B2

(12) United States Patent
Shimomura et al.

(10) Patent No.: US 11,155,110 B2
(45) Date of Patent: Oct. 26, 2021

(54) INKJET PRINTER WITH FLOW ADJUSTER

(71) Applicant: RISO KAGAKU CORPORATION, Tokyo (JP)

(72) Inventors: Kenji Shimomura, Ibaraki (JP); Hironao Adachi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/823,399

(22) Filed: Mar. 19, 2020

(65) Prior Publication Data

US 2020/0307284 A1 Oct. 1, 2020

(30) Foreign Application Priority Data

Mar. 26, 2019 (JP) ..... JP2019-058959
Mar. 26, 2019 (JP) ..... JP2019-058962
Sep. 30, 2019 (JP) ..... JP2019-178784

(51) Int. Cl.
*B41J 2/17* (2006.01)
*B41J 29/377* (2006.01)
*B41J 25/308* (2006.01)

(52) U.S. Cl.
CPC ..... *B41J 25/308* (2013.01); *B41J 2/1714* (2013.01)

(58) Field of Classification Search
CPC ..... B41J 2/1714; B41J 2/215; B41J 29/377; B41J 29/38
See application file for complete search history.

(56) References Cited

U.S. PATENT DOCUMENTS

2016/0243857 A1* 8/2016 Otsuka ..... B41J 2/1714
2020/0122468 A1* 4/2020 Takahashi ..... B41J 2/16523

FOREIGN PATENT DOCUMENTS

JP 03208651 A * 9/1991
JP 03208652 A * 9/1991
JP 2007-136847 A 6/2007
JP 2010-89391 A 4/2010

OTHER PUBLICATIONS

Shiina, MachineTranslationofJP03208652.pdf, 1991 (Year: 1991).*
Shiina, MachineTranslationofJP03208651.pdf, 1991 (Year: 1991).*

* cited by examiner

*Primary Examiner* — Scott A Richmond
(74) *Attorney, Agent, or Firm* — Greenblum & Bernstein, P.L.C.

(57) ABSTRACT

An inkjet printer includes: a conveyer configured to convey a print medium; an inkjet head configured to eject ink to the print medium conveyed by the conveyer; a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is.

7 Claims, 27 Drawing Sheets

56

| INK TEMPERATURE | DUTY RATIO |
|---|---|
| T1 ≤ AND < T2 | D1 |
| T2 ≤ AND < T3 | D2 |
| ... | ... |

156

| SURFACE TENSION | DUTY RATIO |
|---|---|
| S1 ≤ AND < S2 | D1 |
| S2 ≤ AND < S3 | D2 |
| ... | ... |

COMPARATIVE EXAMPLE

241

| INK TEMPERATURE | DUTY RATIO |
|---|---|
| Ta1 ≤ AND < Ta2 | Da1 |
| Ta2 ≤ AND < Ta3 | Da2 |
| ... | ... |

242

| INK TEMPERATURE | DUTY RATIO |
|---|---|
| Tb1 ≤ AND < Tb2 | Db1 |
| Tb2 ≤ AND < Tb3 | Db2 |
| ... | ... |

COMPARATIVE EXAMPLE

INKJET PRINTER WITH FLOW ADJUSTER

CROSS REFERENCE TO RELATED APPLICATION

This application is based upon and claims the benefit of priority from the prior Japanese Patent Application Nos. 2019-058959 filed on Mar. 26, 2019, 2019-058962 filed on Mar. 26, 2019, and 2019-178784 filed on Sep. 30, 2019, the entire contents of which are incorporated herein by reference.

BACKGROUND

1. Technical Field

The disclosure relates to an inkjet printer which performs printing by ejecting ink from an inkjet head.

2. Related Art

There is known an inkjet printer which forms an image by ejecting droplets of ink from nozzles of an inkjet head onto a print medium.

In the inkjet printer, satellite droplets which are fine droplets (also referred to as ink mist) are generated in the ink ejection as described in Japanese Patent Application Publication No. 2010-89391. The satellite droplets cause smear (mist smear) on a printed sheet.

SUMMARY

The lower the temperature of the ink is, and the higher the viscosity of the ink is, the more likely the satellite droplets are generated in the ink ejection. Accordingly, the satellite droplets can be reduced by heating the ink.

However, the method of reducing the satellite droplets by performing heating control of the ink as described above cannot be achieved unless there is a mechanism for heating the ink.

Japanese Patent Application Publication No. 2007-136847 discloses a technique of sucking and collecting the ink mist floating in the air by using a mist aspiration fan.

However, even when the ink mist is collected by using a mechanism for collecting the ink mist as in the aforementioned technique, part of the ink mist before being collected adheres to the printed sheet and causes the mist smear in some cases.

Furthermore, the lower the ink temperature is, the finer the satellite droplets tend to be. The smaller the satellite droplets are, the more easily the satellite droplets are swept away by an air flow.

The disclosure is directed to an inkjet printer which can reduce mist smear on a printed sheet.

An inkjet printer in accordance with some embodiments includes: a conveyer configured to convey a print medium; an inkjet head configured to eject ink to the print medium conveyed by the conveyer; a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is.

The aforementioned configuration can reduce mist smear on a printed sheet.

The controller may be configured to control the flow adjuster such that the lower a temperature of the ink to be ejected by the inkjet head is, the stronger the air flow in the under-head space is.

The aforementioned configuration can reduce mist smear on a print sheet without performing heating control of the ink.

The inkjet printer may further include a temperature adjuster configured to adjust the temperature of the ink in the inkjet head. The controller may be configured to: control the flow adjuster such that the lower the temperature of the ink in the inkjet head is, the stronger the air flow in the under-head space is; and control the temperature adjuster to maintain the temperature of the ink in the inkjet head at or above a prescribed temperature upon a maximum ejection amount of the ink per pixel in the inkjet head being equal to or less than a threshold.

The aforementioned configuration can reduce mist smear on a print sheet while reducing ink landing position deviation.

The controller may be configured to control the flow adjuster such that the lower a surface tension of the ink to be ejected by the inkjet head is, the stronger the air flow in the under-head space is.

The aforementioned configuration can reduce mist smear on a printed sheet.

DETAILED DESCRIPTION

Figure 1:
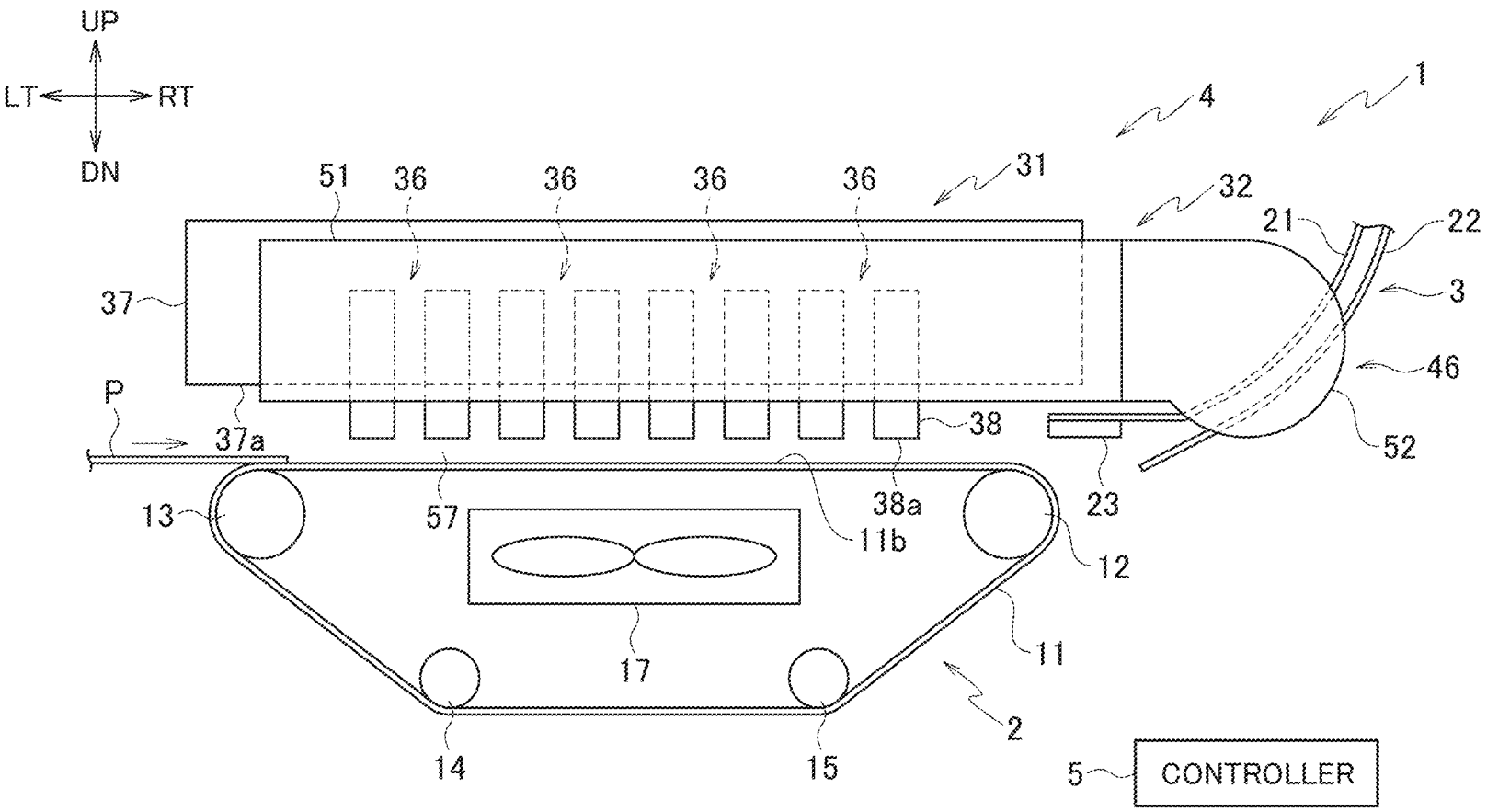
FIG. 1 is a schematic configuration diagram of an inkjet printer according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
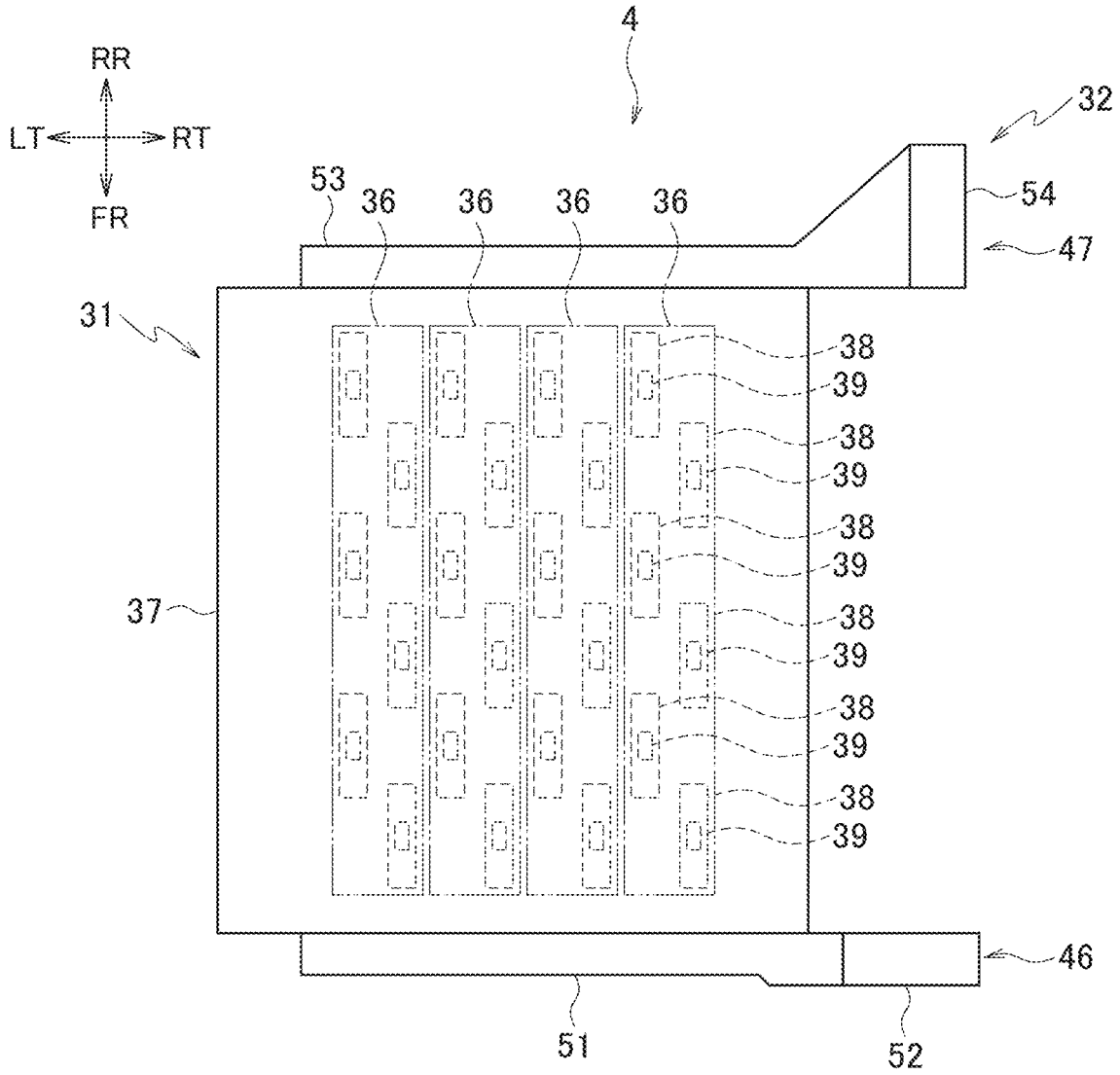
FIG. 2 is a plan view of a printer in the inkjet printer 1 illustrated in FIG. 1.
Figure 3:
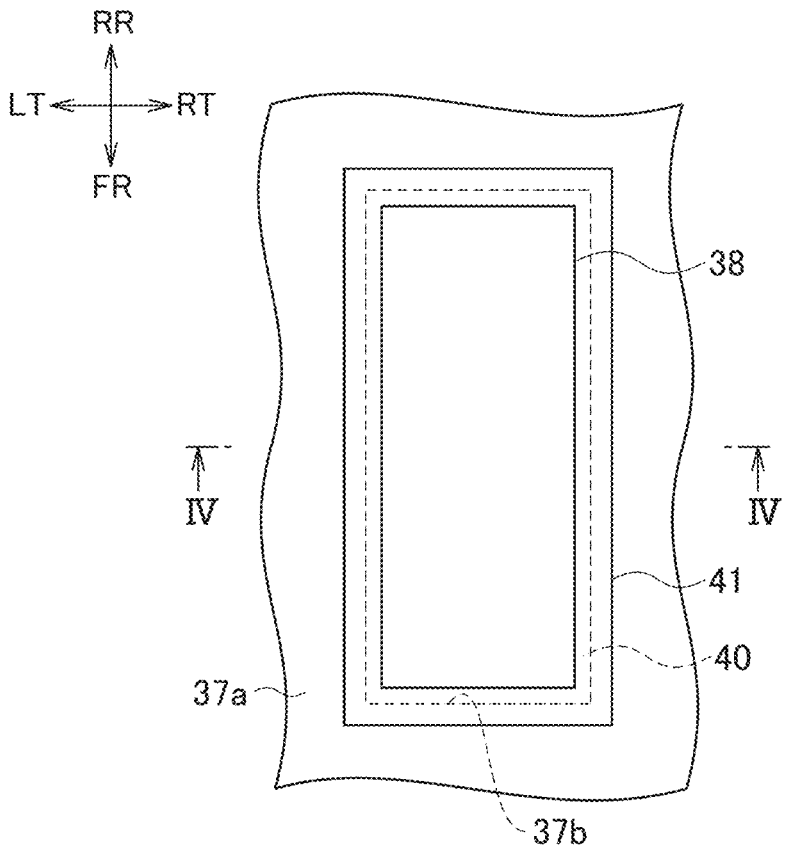
FIG. 3 is a plan view of a portion around a head module of the printer in the first embodiment.
Figure 4:
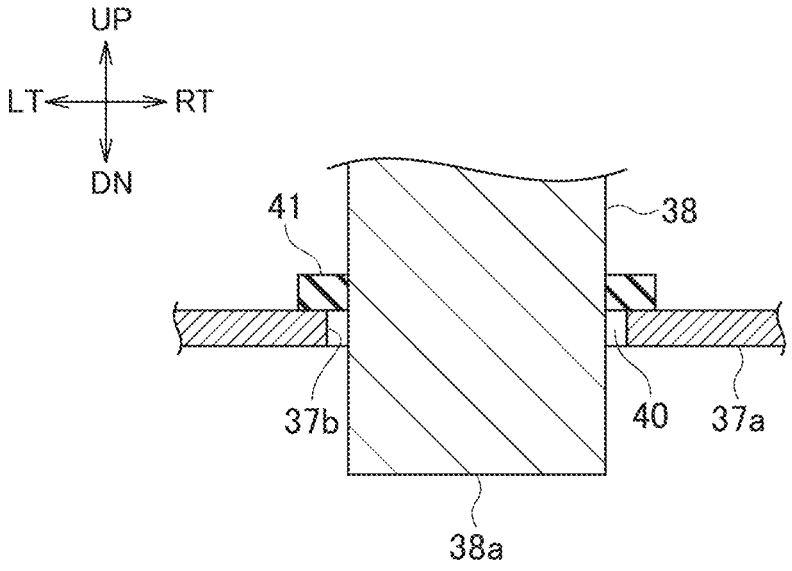
FIG. 4 is a cross-sectional view taken along the line IV-IV in FIG. 3.
Figures 5, 6:
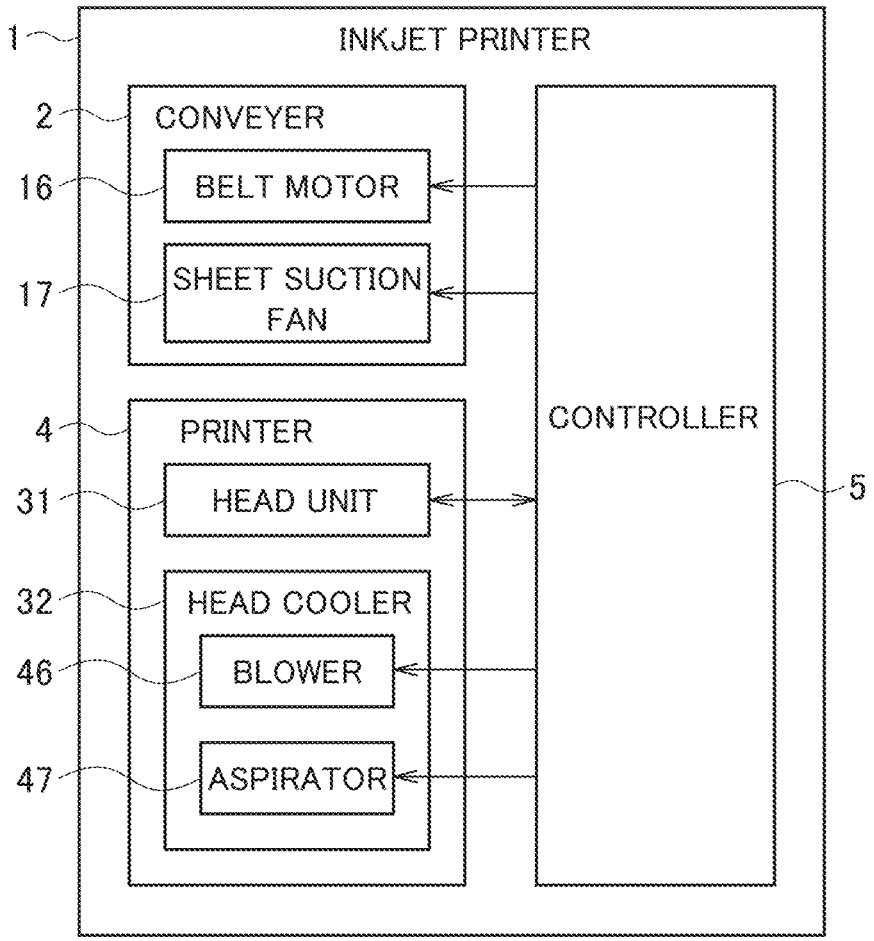
FIG. 5 is a control block diagram of the inkjet printer illustrated in FIG. 1.
FIG. 6 is a diagram illustrating a sheet suction fan drive table according to the first embodiment.

FIG. 1 is a schematic configuration diagram of an inkjet printer 1 according to a first embodiment. FIG. 2 is a plan view of a printer 4 in the inkjet printer 1 illustrated in FIG. 1. FIG. 3 is a plan view of a portion around a head module 38 of the printer 4. FIG. 4 is a cross-sectional view taken along the line IV-IV in FIG. 3. FIG. 5 is a control block diagram of the inkjet printer 1 illustrated in FIG. 1. In the following description, the direction orthogonal to the sheet surface of FIG. 1 is referred to as a front-rear direction and the direction from the sheet surface toward the viewer is referred to as the front side. Moreover, up, down, left, and right on the sheet surface of FIG. 1 are referred to as directions of up, down, left, and right. In FIG. 1, the direction from left to right is a conveyance direction of a sheet P which is a print medium. Upstream and downstream in the following description mean upstream and downstream in the conveyance direction of the sheet P. In FIGS. 1 to 4, 7, 9, and 12 to 16, the directions of right, left, up, down, front, and rear are denoted by RT, LT, UP, DN, FR, and RR, respectively.

As illustrated in FIGS. 1 and 5, the inkjet printer 1 according to the first embodiment includes a conveyer 2, a guide 3, the printer 4, and a controller 5.

The conveyer 2 conveys the sheet P fed from a sheet feeder (not illustrated) by means of air aspiration. The conveyer 2 includes a conveyer belt 11, a drive roller 12, following rollers 13 to 15, a belt motor 16, and a sheet suction fan 17.

The conveyer belt 11 conveys the sheet P while sucking and holding the sheet P. The conveyer belt 11 is an annular belt wound around the drive roller 12 and the following rollers 13 to 15. Multiple belt holes 11*a* (see FIG. 9) are formed in the conveyer belt 11. The conveyer belt 11 sucks and holds the sheet P on a conveyance surface 11*b* by using sucking force generated at the belt holes 11*a* by drive of the sheet suction fan 17. The conveyance surface lib is an upper surface of a horizontal portion of the conveyer belt 11 between the drive roller 12 and the following roller 13. The conveyer belt 11 is rotated clockwise in FIG. 1 to convey the sucked and held sheet P toward the right side.

The drive roller 12 rotates the conveyer belt 11 clockwise in FIG. 1.

The following rollers 13 to 15 support the conveyer belt 11 together with the drive roller 12. The following rollers 13 to 15 are rotated by the drive roller 12 via the conveyer belt 11 to follow the drive roller 12. The following roller 13 is arranged on the left side of the drive roller 12 at the same height as the drive roller 12. The following rollers 14 and 15 are arranged below the drive roller 12 and the following roller 13, at the same height while being spaced away from each other in a left-right direction.

The belt motor 16 rotationally drives the drive roller 12.

The sheet suction fan 17 generates a downward air flow. The sheet suction fan 17 thereby aspirates air through the belt holes 11*a* of the conveyer belt 11 and generates negative pressure at the belt holes 11*a* to suck the sheet P on the conveyer belt 11. The sheet suction fan 17 is arranged in a region surrounded by the annular conveyer belt 11.

The guide 3 guides the sheet P conveyed downstream of the conveyer 2. The guide 3 includes paired guide plates 21, 22 and a mist adsorption member 23.

The guide plates 21, 22 are members which guide the sheet P conveyed from the conveyer 2 to a conveyance mechanism (not illustrated) downstream of the conveyer 2.

The mist adsorption member 23 is a member which collects ink mist (satellite droplets) generated by ink ejection from the inkjet heads 36 to be described later by adsorbing the ink mist. The mist adsorption member 23 is installed on the guide plate 21.

The printer 4 performs printing on the sheet P conveyed by the conveyer 2. The printer 4 is arranged above the conveyer 2. The printer 4 includes a head unit 31 and a head cooler 32.

The head unit 31 prints an image by ejecting ink to the sheet P. The head unit 31 includes the multiple inkjet heads 36 and a head holder 37. In the first embodiment, the head unit 31 includes four inkjet heads 36.

The inkjet heads 36 eject the ink to the sheet P. The four inkjet heads 36 eject ink of different colors (for example, black, cyan, magenta, and yellow), respectively. The four inkjet heads 36 are arranged parallel to one another in the conveyance direction (left-right direction) of the sheet P. Each inkjet head 36 has multiple head modules 38. In the first embodiment, each inkjet head 36 has six head modules 38.

Each head module 38 has an ink chamber (not illustrated) which stores the ink and multiple nozzles (not illustrated) from which the ink is ejected. Piezoelectric elements (not illustrated) are arranged in the ink chamber. The ink is ejected from the nozzles by drive of the piezoelectric elements. The nozzles of the head module 38 are opened on an ejection surface 38*a* which is a lower surface facing the conveyance surface 11*b* of the conveyer belt 11. The nozzles are arranged in the front-rear direction (main scanning direction).

In each inkjet head 36, the head modules 38 are arranged in the front-rear direction while zigzagging. Specifically, in each inkjet head 36, the six head modules 38 are arranged in the front-rear direction with their positions in the left-right direction alternately shifted.

Each head module 38 ejects, from the nozzles, the ink supplied by an ink circulation mechanism (not illustrated) provided for each inkjet head 36. The ink circulation mechanism is a mechanism which supplies the ink to the head modules 38 of the inkjet head 36 while circulating the ink. The ink circulation mechanism is provided with an ink cooler (not illustrated) for cooling the ink.

Each head module 38 is provided with a temperature sensor 39. The temperature sensor 39 detects an ink temperature in the head module 38.

The head holder 37 holds the inkjet heads 36. The head holder 37 is formed of a hollow box body. The head holder 37 is arranged above the conveyer 2. As illustrated in FIGS. 3 and 4, attachment opening portions 37*b* to which the head modules 38 of the inkjet heads 36 are attached are formed in a bottom plate 37*a* of the head holder 37. As many attachment opening portions 37*b* as the head modules 38 are formed in the bottom plate 37*a* of the head holder 37. The head holder 37 holds the head modules 38 with lower end portions of the head modules 38 protruding downward from the attachment opening portions 37*b*.

Each of the attachment opening portions 37*b* is a through hole larger than a cross-sectional area of the head module 38 along a horizontal plane. The attachment position and angle of the head module 38 are thus adjustable. Since the attachment opening portion 37*b* has such a size, the head module 38 is attached to the attachment opening portion 37*b* with a gap 40 therebetween.

The head holder 37 is provided with sealing members 41. The sealing members 41 are members which close the gaps 40 between the head modules 38 and the attachment opening portions 37*b*.

The head cooler 32 generates cooling air in the head holder 37 and cools the inkjet heads 36 with this cooling air. The head cooler 32 includes a blower 46 and an aspirator 47.

The blower 46 blows air from the outside to the inside of the head holder 37. The blower 46 is arranged on the front side of the head holder 37. The blower 46 includes a blowing chamber 51 and a blowing fan 52.

The blowing chamber 51 forms a flow passage of air between the blowing fan 52 and the head holder 37. The blowing chamber 51 is formed in a hollow shape elongating in the left-right direction. The blowing chamber 51 is arranged on a front side plate of the head holder 37.

Multiple blowing holes (not illustrated) are formed on a surface of the blowing chamber 51 in contact with the head holder 37. The blowing holes of the blowing chamber 51 are ports through which air flows out from the blowing chamber 51 when air is blown into the head holder 37. The blowing holes of the blowing chamber 51 are arranged at positions corresponding to air passage holes (not illustrated) formed in the front side plate of the head holder 37. Air can be thereby blown from the blower 46 into the head holder 37.

The blowing fan 52 sends air from one end of the blowing chamber 51 into the blowing chamber 51. Air is thereby blown into the head holder 37 via the blowing chamber 51.

The aspirator 47 aspirates air from the head holder 37. The aspirator 47 is arranged on the rear side of the head holder 37. The aspirator 47 includes an aspiration chamber 53 and an aspiration fan 54.

The aspiration chamber 53 forms a flow passage of air between the head holder 37 and the aspiration fan 54. The aspiration chamber 53 is formed in a hollow shape elongating in the left-right direction. The aspiration chamber 53 is arranged on a rear side plate of the head holder 37.

Multiple aspiration holes (not illustrated) are formed on a surface of the aspiration chamber 53 in contact with the head holder 37. The aspiration holes of the aspiration chamber 53 are ports through which air flows into the aspiration chamber 53 when air is aspirated from the head holder 37. The aspiration holes of the aspiration chamber 53 are arranged at positions corresponding to air passage holes (not illustrated) formed in the rear side plate of the head holder 37. The aspirator 47 can thereby aspirate air from the head holder 37.

The aspiration fan 54 aspirates air from one end of the aspiration chamber 53. Air is thus aspirated from the head holder 37 via the aspiration chamber 53.

The controller 5 controls operations of the units in the inkjet printer 1. The controller 5 includes a CPU, a RAM, a ROM, a hard disk drive, and the like.

The controller 5 stores a sheet suction fan drive table 56 illustrated in FIG. 6. The sheet suction fan drive table 56 is a table in which the ink temperatures in the inkjet heads 36 are associated with duty ratios (drive ratios) of a drive signal of the sheet suction fan 17. In the sheet suction fan drive table 56 of FIG. 6, duty ratios D1, D2, . . . satisfy relationships of D1>D2> . . . .

In this case, the higher the duty ratio of the drive signal of the sheet suction fan 17 is, the higher the number of revolutions of the sheet suction fan 17 is. Moreover, as described later, the higher the number of revolutions of the sheet suction fan 17 is, the stronger the air flows in under-heads spaces 57 are, the under-head spaces 57 being spaces between the conveyance surface lib and the inkjet heads 36. In the first embodiment, the sheet suction fan 17 has a function of an adjuster which adjusts the strengths of air flows in the under-head spaces.

In a printing operation, the controller 5 controls the duty ratio of the drive signal of the sheet suction fan 17 based on the ink temperature in the inkjet heads 36, by referring to the sheet suction fan drive table 56. Specifically, in the printing operation, the controller 5 controls the sheet suction fan 17 such that the lower the temperature of the ink to be ejected by the inkjet heads 36 is, the stronger the air flows in the under-head spaces 57 are.

Next, operations of the inkjet printer 1 are described.

When a print job is inputted, the controller 5 starts drive of the conveyer 2. Specifically, the controller 5 starts drive of the drive roller 12 by using the belt motor 16. Circulation drive of the conveyer belt 11 is thereby started. Moreover, the controller 5 starts drive of the sheet suction fan 17. The drive of the sheet suction fan 17 causes air to be aspirated through the belt holes 11*a* of the conveyer belt 11 and generates negative pressure at the belt holes 11*a* and the sucking force is generated.

Furthermore, the controller 5 starts drive of the blowing fan 52 and the aspiration fan 54 in the head cooler 32. The drive of the blowing fan 52 causes air to be blown into the head holder 37 via the blowing chamber 51. Moreover, the drive of the aspiration fan 54 causes air to be aspirated from the head holder 37 via the aspiration chamber 53. The cooling air flowing from the front side to the rear side is thereby generated in the head holder 37.

When the drive of the conveyer 2 and the head cooler 32 is started, as many sheets P as the sheets to be printed in the print job are fed to the conveyer 2 one by one. The fed sheets P are conveyed while being sucked and held on the conveyer belt 11 of the conveyer 2. In the conveyer 2, the sheets P are conveyed at predetermined sheet intervals. The controller 5 prints images by causing the head modules 38 of the inkjet heads 36 to eject the ink to the sheets P conveyed by the conveyer belt 11.

When the head modules 38 are driven, the head modules 38 generate heat. Temperature rise in the head modules 38 may cause failures and the like. To counter this, in the inkjet printer 1, the temperature rise in the head modules 38 is suppressed by the cooling air generated by the head cooler 32.

However, even when the head cooler 32 cools the head modules 38, temperature rise of the ink occurs due to heat generated by the piezoelectric elements in the head modules 38. To counter this, when the ink temperature reaches or exceeds a specified value, the ink coolers of the ink circulation mechanisms cool the ink. Specifically, in the printing operation, the ink temperature changes due to the drive of the head modules 38 and the cooling of the ink by the ink circulation mechanisms. Moreover, the ink temperature sometimes changes depending on an environment temperature of a location where the inkjet printer 1 is installed.

Figure 7:
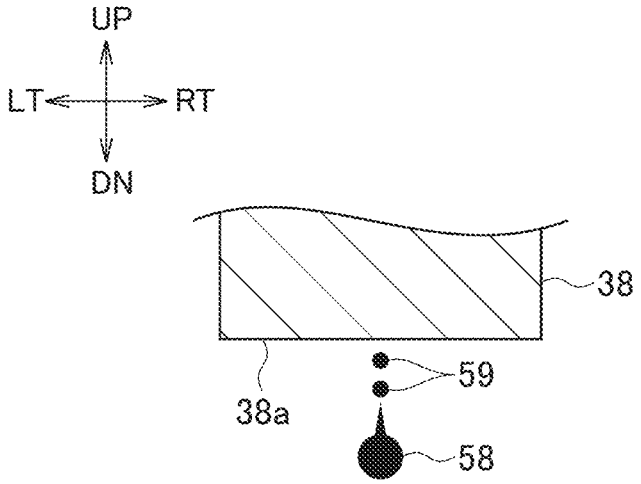
FIG. 7 is an explanatory view of satellite droplets according to the first embodiment.

When the ink is ejected from the nozzles of the head modules 38, the ejected ink flies while forming a tail and there are a time difference and a speed difference between a front head portion and a rear tail portion of the flying ink. Accordingly, as illustrated in FIG. 7, satellite droplets 59 which are unnecessary fine droplets are formed to accompany a main droplet 58 which is a preceding main droplet. When the satellite droplets 59 adhere to the sheet P, the satellite droplets 59 cause smear on a printed sheet.

Figure 8:
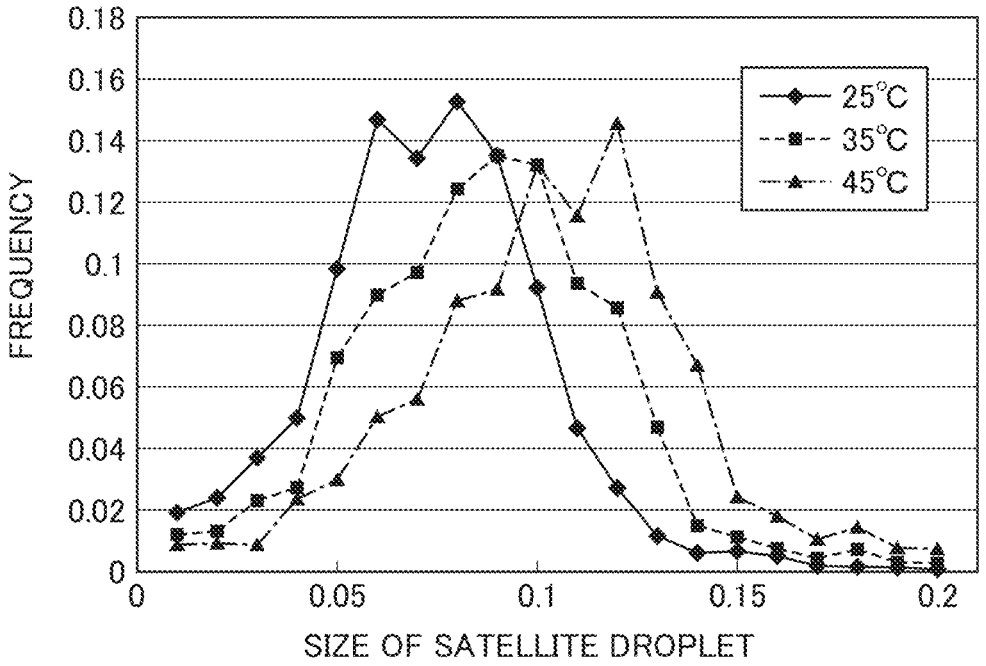
FIG. 8 is a graph illustrating an example of distribution of the size of the satellite droplets at each ink temperature according to the first embodiment.

The size of the satellite droplets is affected by the ink temperature. FIG. 8 illustrates an example of distribution of the size of the satellite droplets at each ink temperature. FIG. 8 is a graph formed by obtaining the numbers and sizes of satellite droplets in the ink ejection by means of image analysis and presenting them as a histogram. The sizes of the satellite droplets are based on the size of the main droplet 58 which is not affected by the ink temperature. As illustrated in FIG. 8, there is a tendency that the lower the ink temperature is, the finer the satellite droplets are.

The smaller the satellite droplets are, the more likely the satellite droplets are to be swept away by an air flow. Accordingly, in the inkjet printer 1, in the printing operation, the air flows in the under-head spaces 57 are adjusted such that the lower the ink temperature is, the stronger the air flows in the under-head spaces 57 are to blow away the fine satellite droplets and prevent them from adhering to the sheet P.

Specifically, in the printing operation, the controller 5 obtains detection values of the temperature sensors 39 of all head modules 38 in the head unit 31 every predetermined time and calculates an average value of the detection values of all temperature sensors 39 as the ink temperature in the inkjet heads 36.

After the calculation of the ink temperature, the controller 5 obtains the duty ratio corresponding to the ink temperature by referring to the sheet suction fan drive table 56 and drives the sheet suction fan 17 at the obtained duty ratio.

Figure 9:
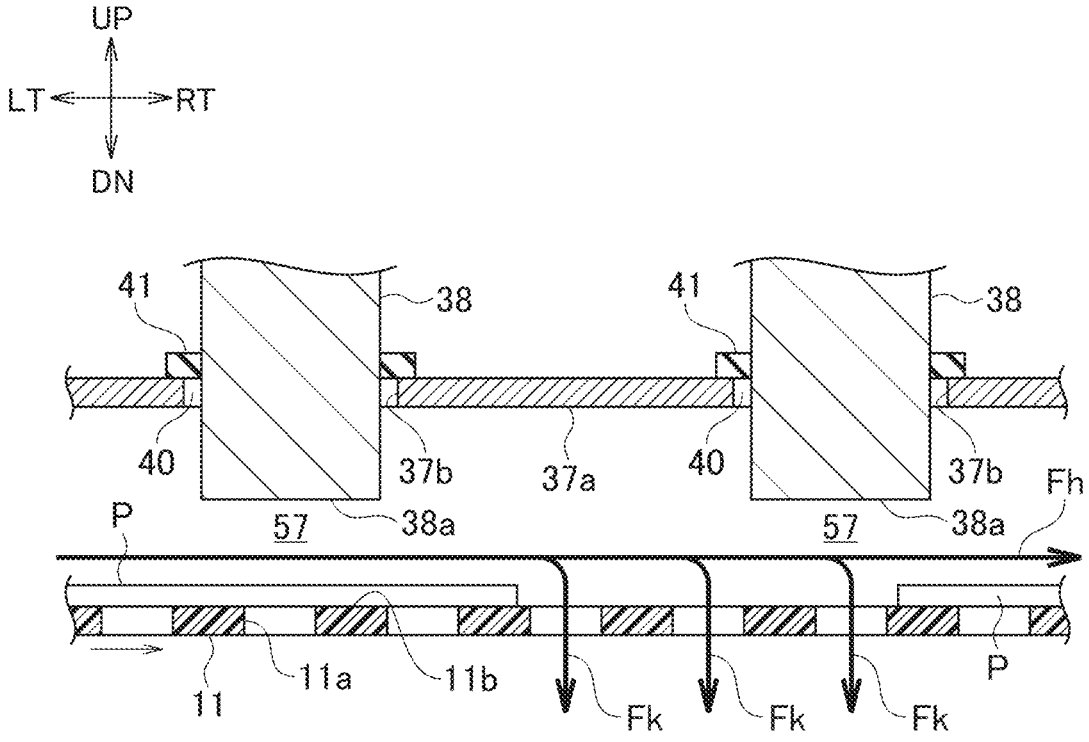
FIG. 9 is an explanatory view of an air flow in an under-head space in the first embodiment.

In this case, in the printing operation, as illustrated in FIG. 9, a conveyance air flow Fh is generated in the under-head spaces 57. The conveyance air flow Fh is an air flow generated by movement of the conveyer belt 11 and the sheet P. The conveyance air flow Fh flows in the conveyance direction of the sheet P.

Moreover, in a sheet interval region between the conveyed sheet P and sheet P, there is no sheet P on the belt holes 11*a* and the belt holes 11*a* are exposed. Accordingly, aspiration air flows Fk are generated. The aspiration air flows Fk are air flows flowing from a space above the conveyance surface 11*b* to an inside of the conveyer 2 through the belt holes 11*a* by the drive of the sheet suction fan 17.

The higher the duty ratio of the drive signal of the sheet suction fan 17 is, the higher the number of revolutions of the sheet suction fan 17 is, and the stronger the aspiration air flows Fk are. When the aspiration air flows Fk become stronger, a combined air flow of the conveyance air flow Fh and the aspiration air flows Fk becomes stronger and thus the air flows in the under-head spaces 57 become stronger.

Accordingly, the controller 5 drives the sheet suction fan 17 at the duty ratio which corresponds to the ink temperature and which is obtained from the sheet suction fan drive table 56 and thereby controls the sheet suction fan 17 such that the lower the ink temperature is, the stronger the air flows in the under-head spaces 57 are.

The air flow thereby blows away the fine satellite droplets and prevents them from adhering to the sheet P when the ink temperature is relatively low and the mist smear on the printed sheet is thereby reduced.

The satellite droplets blown away by the air flow float as ink mist and are collected by being carried by the aspiration air flows Fk and aspirated into the conveyer 2 or by being adsorbed by the mist adsorption member 23.

In this case, large satellite droplets are less likely to be affected by the air flow. Accordingly, when the air flow is made stronger, the large satellite droplets are sometimes not sufficiently blown away and are instead incompletely swept away to land at positions away from the landing position of the main droplet on the sheet P. As a result, the satellite droplets sometimes land in a white portion (no-print area) of the sheet P and cause mist smear. When the air flow is sufficiently weak relative to the size of the satellite droplets, the satellite droplets land on a dot formed by the landed main droplet and mist smear on the printed sheet is suppressed.

The aforementioned control of the sheet suction fan 17 causes air to flow such that the higher the ink temperature is, the weaker the air flows in the under-head spaces 57 are. Accordingly, the mist smear caused by landing of relatively-large satellite droplets in a white portion of the sheet P is also reduced.

Figure 10:
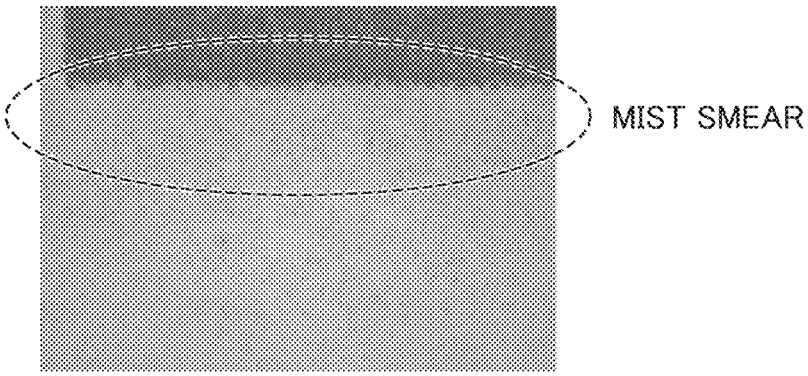
FIG. 10 is a view illustrating mist smear on a printed sheet in the first embodiment.
Figure 11:
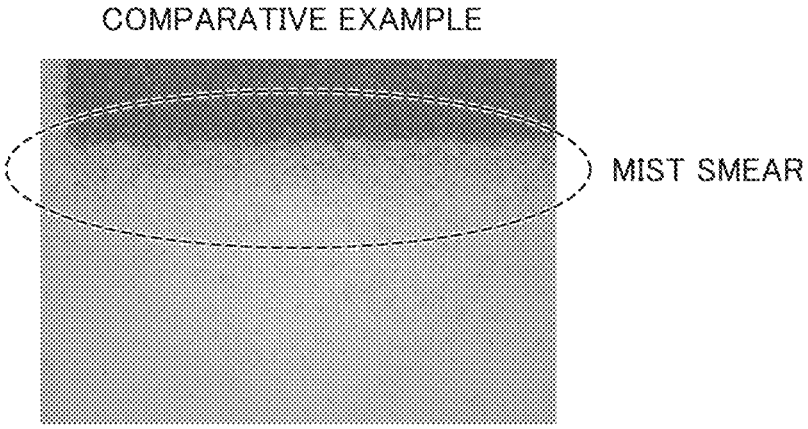
FIG. 11 is a view illustrating mist smear on a printed sheet in a comparative example.

FIG. 10 illustrates an example of the mist smear on the printed sheet in the case where the sheet suction fan 17 is controlled as described above. Moreover, as a comparative example, FIG. 11 illustrates an example of the mist smear on the printed sheet in the case where the sheet suction fan 17 is driven at a constant duty ratio irrespective of the ink temperature. The mist smear in the example of FIG. 10 according to the first embodiment is suppressed more than the mist smear in the comparative example of FIG. 11.

The sheets P subjected to printing by the printer 4 are conveyed by the conveyance mechanism (not illustrated) downstream of the conveyer 2 while being guided by the guide plates 21, 22 and are discharged. When the last sheet P is discharged, the controller 5 stops the drive roller 12 and stops the sheet suction fan 17. Moreover, the controller 5 stops the blowing fan 52 and the aspiration fan 54. The series of operations is thereby completed.

As described above, in the inkjet printer 1, the controller 5 controls the sheet suction fan 17 such that the lower the temperature of the ink to be ejected by the inkjet heads 36 is, the stronger the air flows in the under-head spaces 57 are. This can suppress landing of relatively-large satellite droplets in a white portion of the sheet P when the ink temperature is relatively high, and also cause the air flows to blow away fine satellite droplets and prevent them from adhering to the sheet P when the ink temperature is relatively low. As a result, the mist smear on the printed sheet can be reduced.

Moreover, in the inkjet printer 1, since the mist smear on the printed sheet is reduced by adjusting the strengths of air flows in the under-head spaces 57, heating control of ink for reducing the ink mist (satellite droplets) is unnecessary.

Accordingly, the inkjet printer 1 can reduce the mist smear on the printed sheet without performing the heating control of ink.

Next, a second embodiment partially changed from the first embodiment is described.

Figure 12:
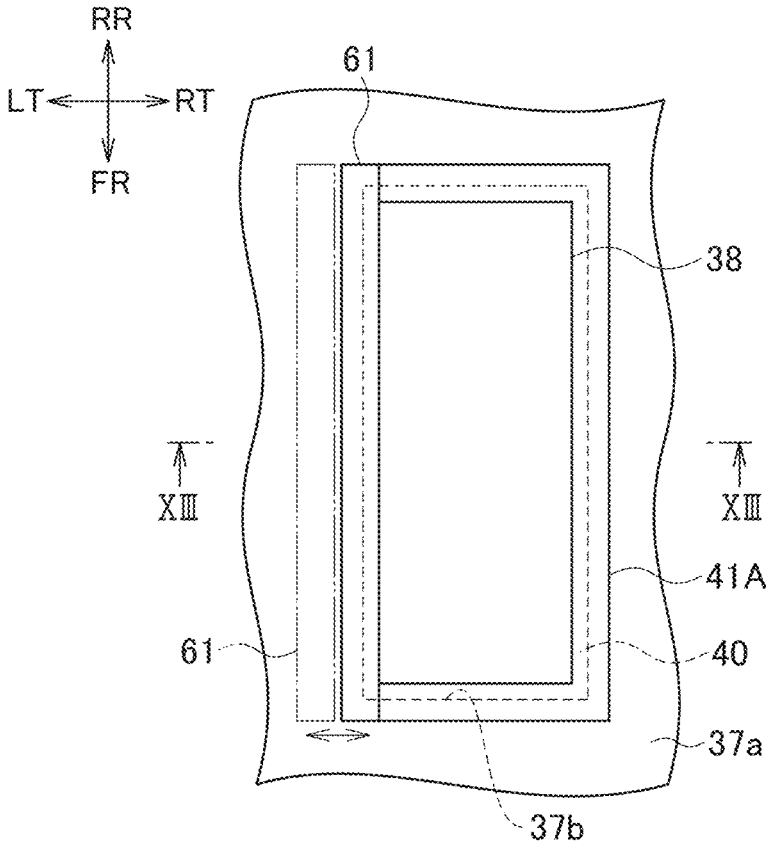
FIG. 12 is a plan view of a portion around a head module of a printer in a second embodiment.
Figure 13:
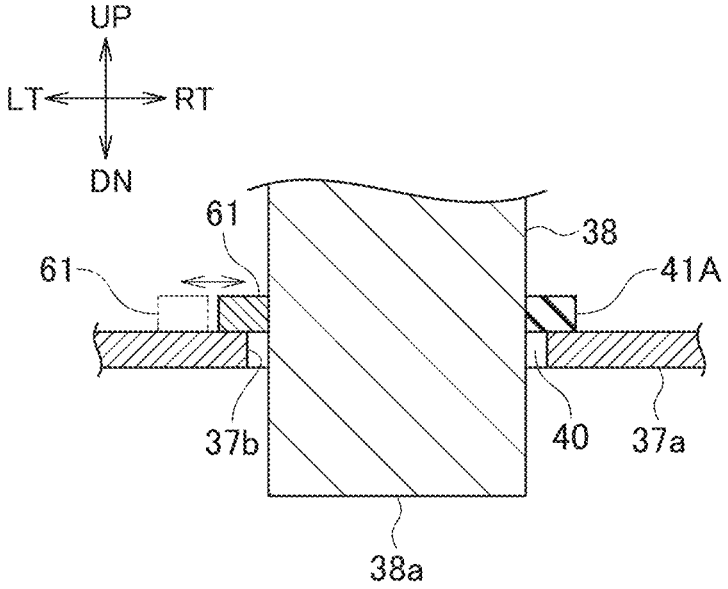
FIG. 13 is a cross-sectional view taken along the line XIII-XIII in FIG. 12.

FIG. 12 is a plan view of a portion around the head module 38 of a printer in the second embodiment. FIG. 13 is a cross-sectional view taken along the line XIII-XIII in FIG. 12.

In the second embodiment, the printer 4 has a configuration in which, as illustrated in FIGS. 12 and 13, the sealing members 41 in the first embodiment are replaced by sealing members 41A and shutters 61 are added.

Each shutter 61 opens and closes part of the corresponding gap 40. In the second embodiment, each shutter 61 opens and closes a portion of the corresponding gap 40 extending along a left side surface of the corresponding head module 38. When the shutters 61 open, the cooling air in the head holder 37 leaks out and flows to the under-head spaces 57 through the gaps 40 and the air flows in the under-head spaces 57 become strong. The shutters 61 have a function of an adjuster capable of individually adjusting the strengths of the air flows in the under-head spaces 57 of the respective inkjet heads 36.

The sealing member 41A is a member which closes a portion of the gap 40 other than the portion opened and closed by the shutter 61.

In the second embodiment, in the printing operation, for each inkjet head 36, the controller 5 controls the shutters 61 corresponding to the head modules 38 in the inkjet head 36 such that the lower the temperature of the ink to be ejected by the inkjet head 36 is, the stronger the air flow in the under-head space 57 of the inkjet head 36 is.

Specifically, in the printing operation, the controller 5 obtains the detection values of the temperature sensors 39 of the head modules 38 in each inkjet head 36 every predetermined time. Then, the controller 5 calculates an average value of the detection values of the temperature sensors 39 in each inkjet head 36 as the ink temperature in the inkjet head 36.

After the calculation of the ink temperature in each inkjet head 36, for each inkjet head 36, the controller 5 performs opening and closing control of the shutters 61 corresponding to the head modules 38 in the inkjet head 36 based on the ink temperature. In this case, the controller 5 performs control such that the lower the ink temperature is, the longer the opening time of the shutters 61 is.

Figure 14:
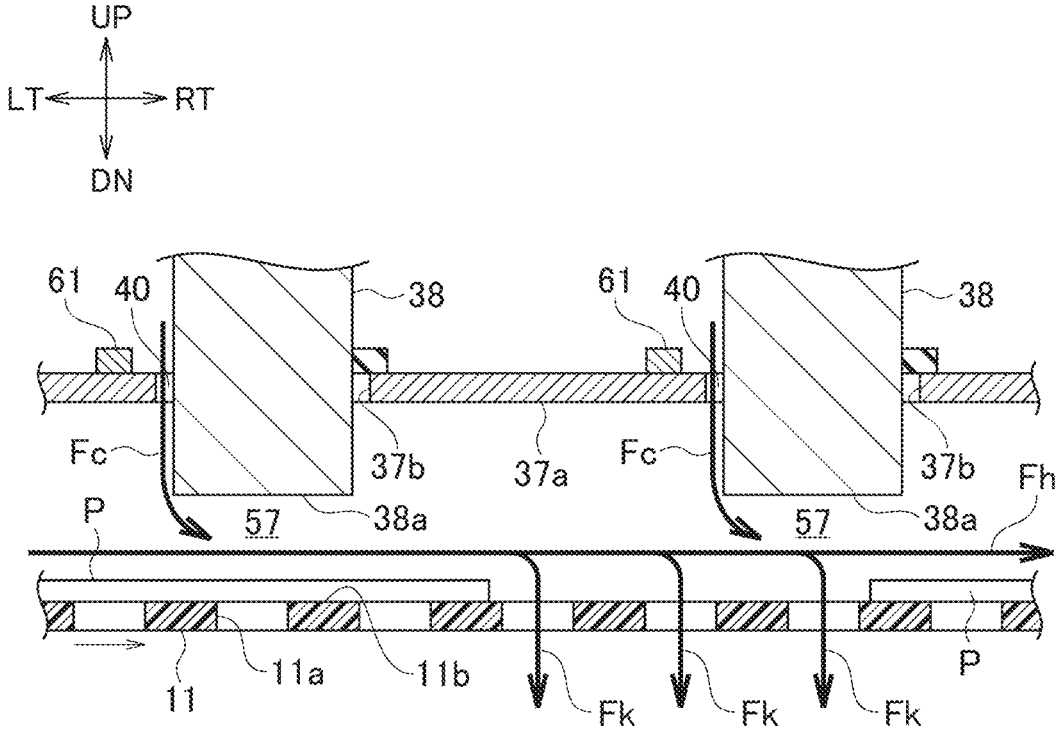
FIG. 14 is an explanatory view of an air flow in an under-head space in the second embodiment.

When the shutters 61 are open, as illustrated in FIG. 14, cooling leaking air flows Fc flow to the under-head space 57. The cooling leaking air flows Fc are the cooling air in the head holder 37 leaking from the gaps 40. When the cooling leaking air flows Fc flow to the under-head space 57, the air flow in the under-head space 57 becomes stronger than that in the case where the shutters 61 are closed. Moreover, the strength of the air flow in the under-head space 57 can be adjusted by adjusting the opening time of the shutters 61.

Accordingly, the lower the ink temperature is, the stronger the air flow in the under-head space 57 can be made by increasing the opening time of the shutters 61. The opening time of the shutters 61 corresponding to the ink temperature is set in advance such that the air flow in the under-head space 57 flows at the strength corresponding to the ink temperature.

As described above, in the second embodiment, for each inkjet head 36, the controller 5 controls the shutters 61 corresponding to the head modules 38 in the inkjet head 36 such that the lower the temperature of the ink to be ejected by the inkjet head 36 is, the stronger the air flow in the under-head space 57 of the inkjet head 36 is. For each inkjet head 36, the strength of the air flow in the under-head space 57 of the inkjet head 36 can be thereby adjusted depending on the ink temperature. Accordingly, the mist smear on the printed sheet can be further reduced.

Next, a third embodiment partially changed from the first embodiment is described.

Figure 15:
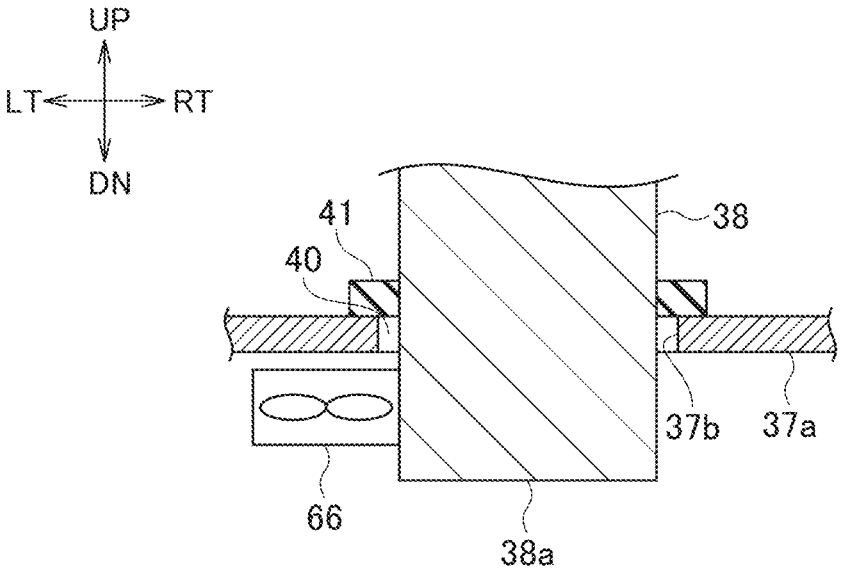
FIG. 15 is a cross-sectional view of a portion around a head module of a printer in a third embodiment.

FIG. 15 is a cross-sectional view of a portion around the head module 38 in a printer in the third embodiment.

In the third embodiment, the printer 4 has a configuration in which, as illustrated in FIG. 15, air flow adjustment fans 66 are added to the printer 4 of the first embodiment.

The air flow adjustment fans 66 are provided near the respective head modules 38 in one to one correspondence with the head modules 38. The air flow adjustment fans 66 generate downward air flows. The stronger the air flows generated by the air flow adjustment fans 66 are, the stronger the air flows in the under-head spaces 57 is. The air flow adjustment fans 66 have a function of an adjuster capable of individually adjusting the strengths of the air flows in the under-head spaces 57 of the respective inkjet heads 36.

In the third embodiment, in the printing operation, for each inkjet head 36, the controller 5 controls the air flow adjustment fans 66 corresponding to the head modules 38 in the inkjet head 36 such that the lower the temperature of the ink to be ejected by the inkjet head 36 is, the stronger the air flow in the under-head space 57 of the inkjet head 36 is.

Specifically, as in the second embodiment, in the printing operation, the controller 5 calculates the average value of the detection values of the temperature sensors 39 in each inkjet head 36 every predetermined time as the ink temperature in the inkjet head 36.

After the calculation of the ink temperature in each inkjet head 36, for each inkjet head 36, the controller 5 controls the air flow adjustment fans 66 corresponding to the head modules 38 in the inkjet head 36 based on the ink temperature. In this case, the controller 5 performs control such that the lower the ink temperature is, the stronger the air flows generated by the air flow adjustment fans 66 are.

Figure 16:
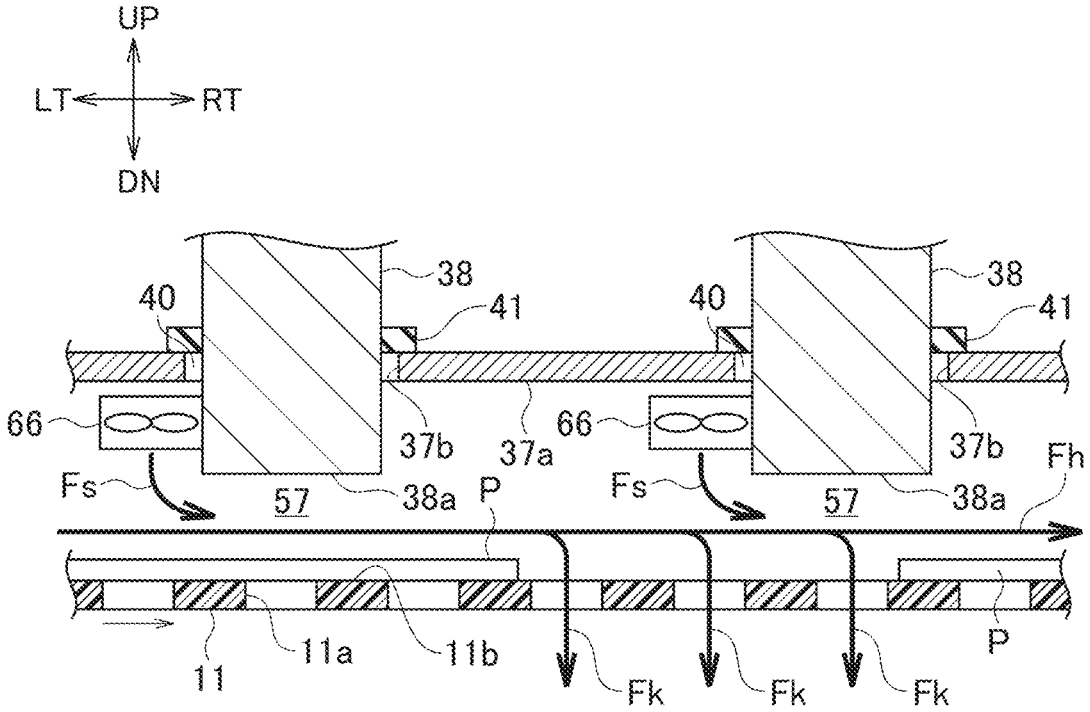
FIG. 16 is an explanatory view of an air flow in an under-head space in the third embodiment.

When the air flow adjustment fans 66 are driven, as illustrated in FIG. 16, adjustment air flows Fs generated by the air flow adjustment fans 66 flow to the under-head space 57. When the adjustment air flows Fs flow to the under-head space 57, the air flow in the under-head space 57 becomes stronger than that in the case where the air flow adjustment fans 66 are stopped. Moreover, the stronger the adjustment air flows Fs are, the stronger the air flow in the under-head space 57 is.

Accordingly, the lower the ink temperature is, the stronger the air flow in the under-head space 57 can be made by increasing a duty ratio of a drive signal of the air flow adjustment fans 66. The duty ratio of the drive signal of the air flow adjustment fans 66 corresponding to the ink temperature is set in advance such that the air flow in the under-head space 57 flows at the strength corresponding to the ink temperature.

As described above, in the third embodiment, for each inkjet head 36, the controller 5 controls the air flow adjustment fans 66 corresponding to the head modules 38 in the inkjet head 36 such that the lower the temperature of the ink to be ejected by the inkjet head 36 is, the stronger the air flow in the under-head space 57 of the inkjet head 36 is. For each inkjet head 36, the strength of the air flow in the under-head space 57 of the inkjet head 36 can be thereby adjusted depending on the ink temperature as in the second embodiment. Accordingly, the mist smear on the printed sheet can be reduced.

In the second embodiment, the shutters 61 in each inkjet head 36 are controlled such that the lower the ink temperature is, the stronger the air flow in the under-head space 57 of the inkjet head 36 is. However, the shutters 61 may be controlled to adjust the strength of the air flow in the under-head space 57 based on the average value of the ink temperatures in all inkjet heads 36 as in the first embodiment. Also in the third embodiment, the air flow adjustment fans 66 may be controlled to adjust the strength of the air flow in the under-head space 57 based on the average value of the ink temperatures in all inkjet heads 36 as in the first embodiment.

Moreover, in the second embodiment, for each head module 38, the shutter 61 may be controlled such that the lower the ink temperature in the head module 38 is, the stronger the air flow in the under-head space 57 of the head module 38 is. Furthermore, in the third embodiment, for each head module 38, the air flow adjustment fan 66 may be controlled such that the lower the ink temperature in the head module 38 is, the stronger the air flow in the under-head space 57 of the head module 38 is.

Moreover, the strengths of the air flows in the under-head spaces 57 may be adjusted by combining the control of the shutters 61 in the second embodiment and the control of the air flow adjustment fans 66 in the third embodiment. Furthermore, the strengths of the air flows in the under-head spaces 57 may be adjusted by combining the control of the sheet suction fan 17 in the first embodiment with at least one of the control of the shutters 61 in the second embodiment and the control of the air flow adjustment fans 66 in the third embodiment.

Moreover, in the second embodiment, the head holder 37 may be configured to be sectioned into parts for the respective inkjet heads 36 and have head coolers configured to generate cooling air for the respective inkjet heads 36. Furthermore, in this configuration, for each inkjet head 36, the strength of the air flow in the under-head space 57 of the inkjet head 36 may be adjusted by combining adjustment of the strength of the cooling air for the inkjet head 36 and the control of the shutters 61. Moreover, the air flow adjustment fans 66 of the third embodiment may be added to this configuration and, for each inkjet head 36, the strength of the air flow in the under-head space 57 of the inkjet head 36 may be adjusted by combining the adjustment of the strength of the cooling air for the inkjet head 36, the control of the shutters 61, and the control of the air flow adjustment fans 66.

Moreover, in the second embodiment, the strength of the air flow in each under-head space 57 is adjusted by adjusting the opening time of the shutters 61. However, the configuration may be such that shutters which adjust the opening areas of the gaps 40 are provided and the strength of the air flow in the under-head space 57 is adjusted by adjusting the opening areas of the gaps 40.

Furthermore, although the configuration in which the strength of the air flow in each under-head space 57 is adjusted by using the air flow adjustment fans 66 configured to generate the downward air flows is described in the third embodiment, the strength of the air flow in the under-head space 57 may be adjusted by using fans configured to generate upward air flows.

Moreover, in the second and third embodiments, the conveyer 2 is not limited to an air aspiration type conveyer and may be a conveyer of a different type such as an electrostatic adsorption type.

Furthermore, although the configuration including multiple inkjet heads 36 is described in the first to third embodiments, the configuration may include only one inkjet head 36.

The embodiments have, for example, the following configurations.

An inkjet printer includes: a conveyer configured to convey a print medium; an inkjet head configured to eject ink to the print medium conveyed by the conveyer; a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is.

The controller may be configured to control the flow adjuster such that the lower a temperature of the ink to be ejected by the inkjet head is, the stronger the air flow in the under-head space is.

The inkjet head may be provided in a plurality. The flow adjuster may be capable of individually adjusting strengths of the air flows in the under-head spaces of the respective inkjet heads. For each of the inkjet heads, the controller may be configured to control the flow adjuster such that the lower the temperature of the ink to be ejected by the inkjet head is, the stronger the air flow in the under-head space of the inkjet head is.

Figure 17:
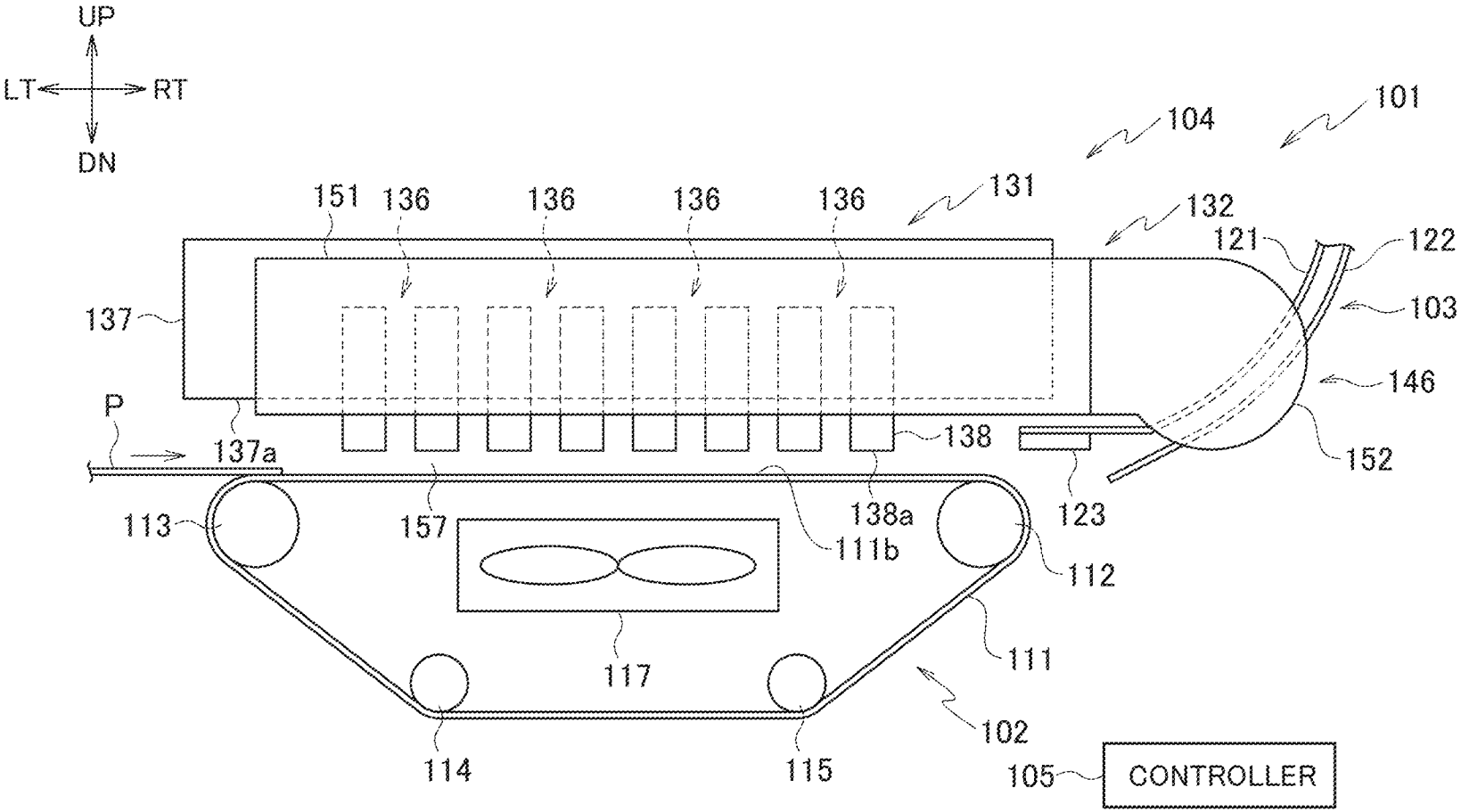
FIG. 17 is a schematic configuration diagram of an inkjet printer according to a fourth embodiment.
Figure 18:
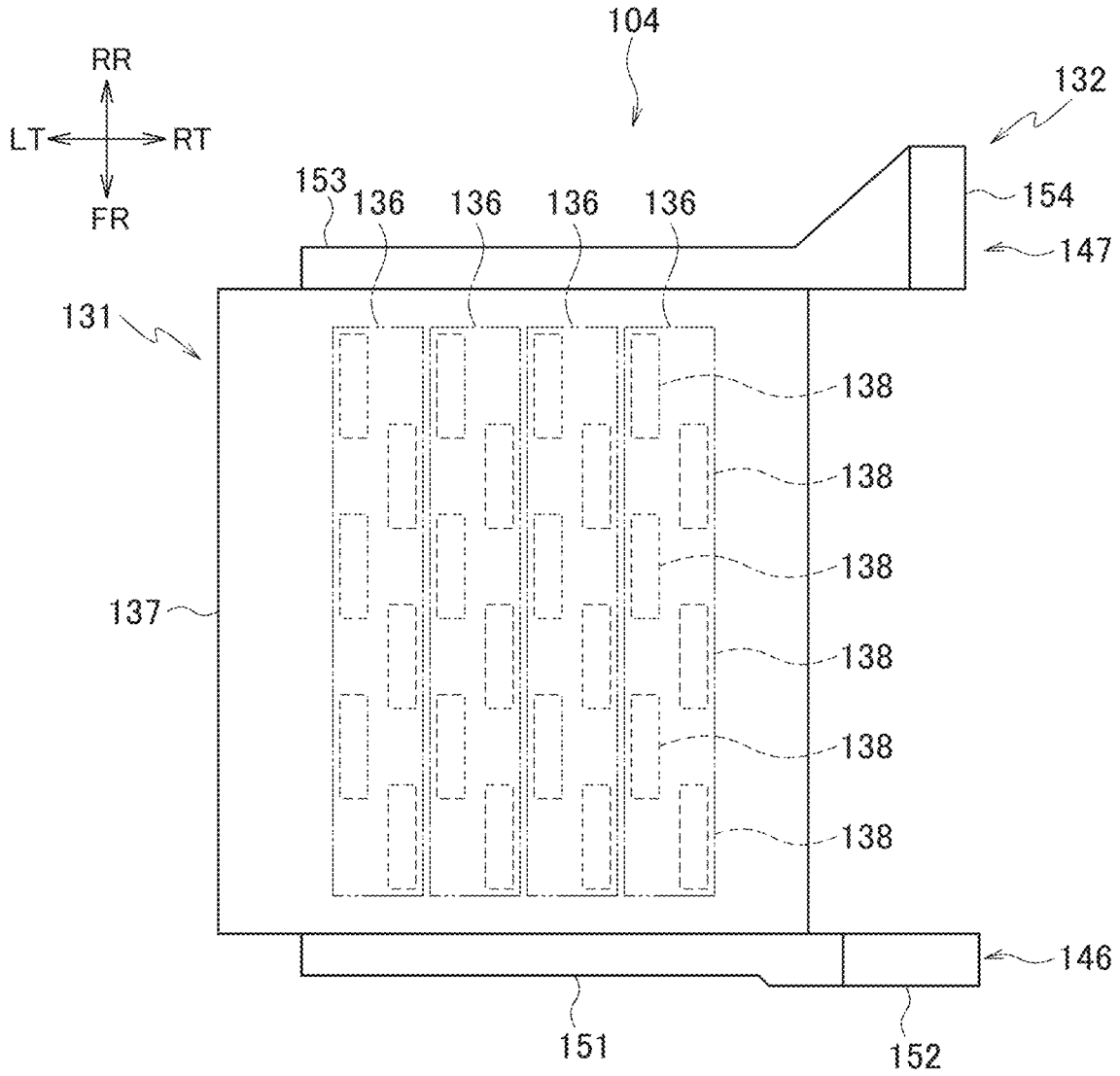
FIG. 18 is a plan view of a printer in the inkjet printer 1 illustrated in FIG. 17.
Figure 19:
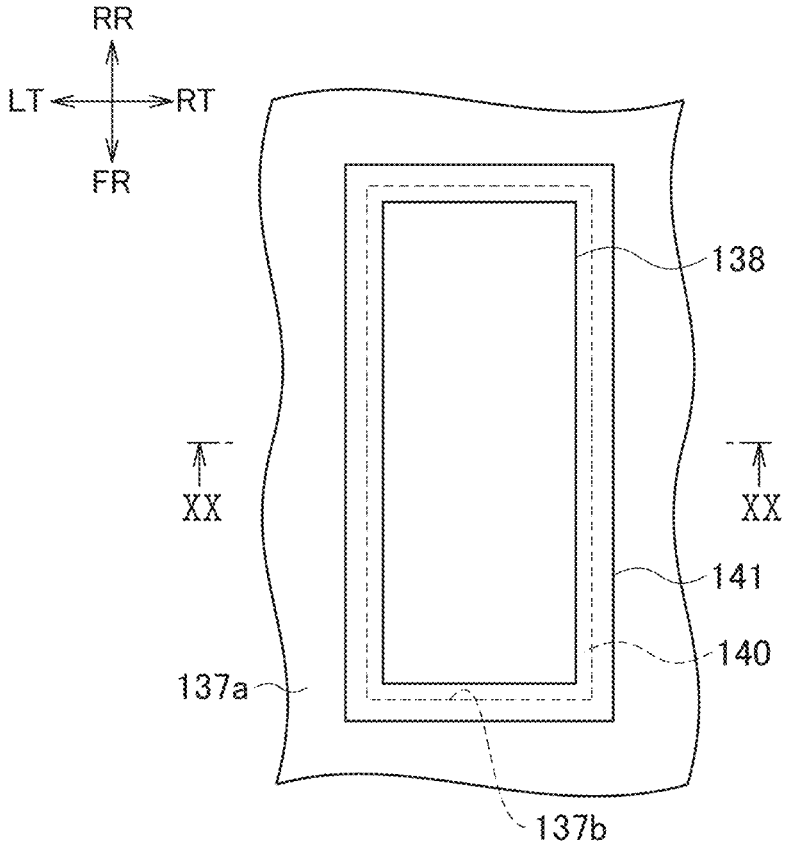
FIG. 19 is a plan view of a portion around a head module of the printer in the fourth embodiment.
Figure 20:
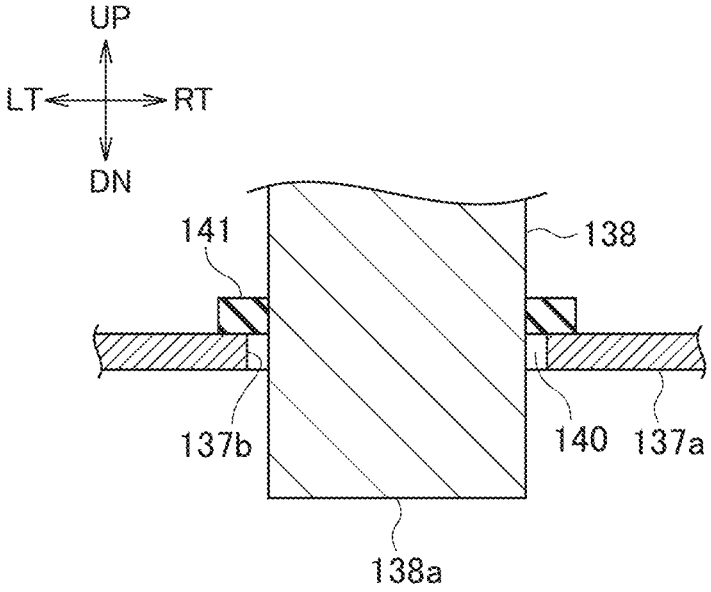
FIG. 20 is a cross-sectional view taken along the line XX-XX in FIG. 19.
Figures 21, 22:
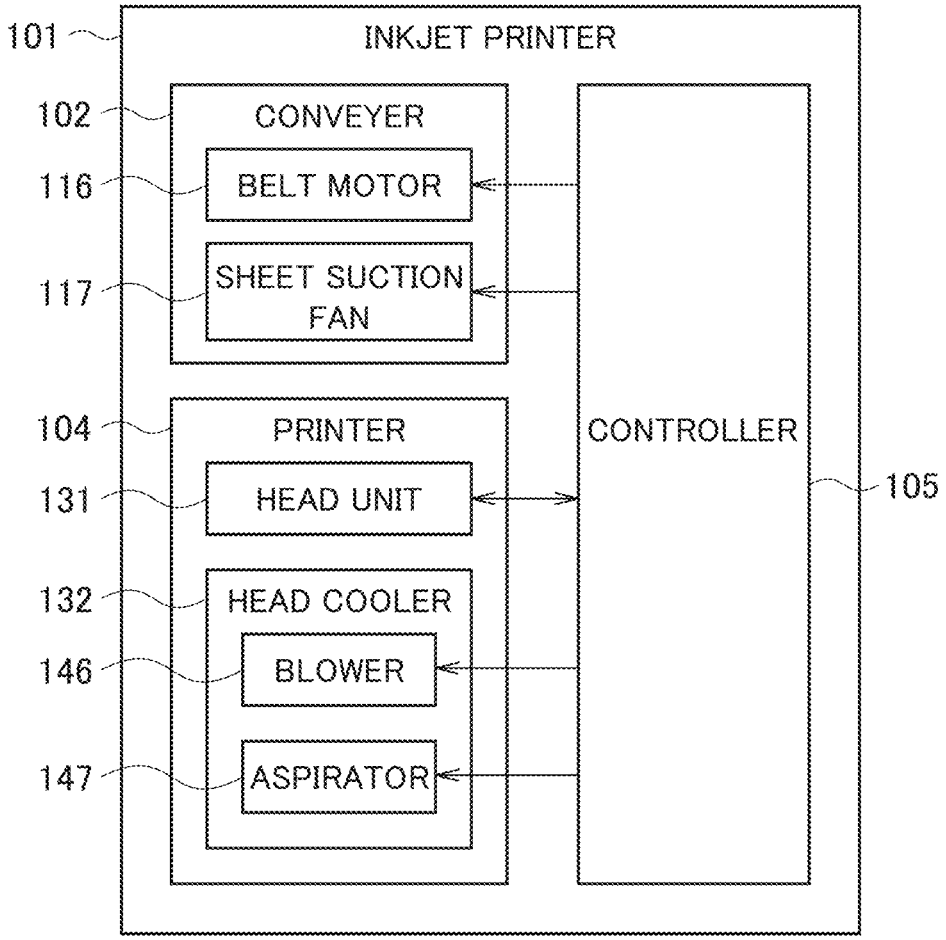
FIG. 21 is a control block diagram of the inkjet printer illustrated in FIG. 17.
FIG. 22 is a diagram illustrating a sheet suction fan drive table according to the fourth embodiment.

Next, a fourth embodiment is described. FIG. 17 is a schematic configuration diagram of an inkjet printer 101 according to the fourth embodiment. FIG. 18 is a plan view of a printer 104 in the inkjet printer 101 illustrated in FIG. 17. FIG. 19 is a plan view of a portion around a head module 138 of the printer 104. FIG. 20 is a cross-sectional view taken along the line XX-XX in FIG. 19. FIG. 21 is a control block diagram of the inkjet printer 101 illustrated in FIG. 17. In the following description, the direction orthogonal to the sheet surface of FIG. 17 is referred to as a front-rear direction and the direction from the sheet surface toward the viewer is referred to as the front side. Moreover, up, down, left, and right on the sheet surface of FIG. 17 are referred to as directions of up, down, left, and right. In FIG. 17, the direction from left to right is a conveyance direction of a sheet P which is a print medium. Upstream and downstream in the following description mean upstream and downstream in the conveyance direction of the sheet P. In FIGS. 17 to 20, 23, 25, and 28 to 32, the directions of right, left, up, down, front, and rear are denoted by RT, LT, UP, DN, FR, and RR, respectively.

As illustrated in FIGS. 17 and 21, the inkjet printer 101 according to the fourth embodiment includes a conveyer 102, a guide 103, the printer 104, and a controller 105.

The conveyer 102 conveys the sheet P fed from a sheet feeder (not illustrated) by means of air aspiration. The conveyer 102 includes a conveyer belt 111, a drive roller 112, following rollers 113 to 115, a belt motor 116, and a sheet suction fan 117.

The conveyer belt 111 conveys the sheet P while sucking and holding the sheet P. The conveyer belt 111 is an annular belt wound around the drive roller 112 and the following rollers 113 to 115. Multiple belt holes 111*a* (see FIG. 25) are formed in the conveyer belt 111. The conveyer belt 111 sucks and holds the sheet P on a conveyance surface 111*b* by using sucking force generated at the belt holes 111*a* by drive of the sheet suction fan 117. The conveyance surface 111*b* is an upper surface of a horizontal portion of the conveyer belt 111 between the drive roller 112 and the following roller 113. The conveyer belt 111 is rotated clockwise in FIG. 17 to convey the sucked and held sheet P toward the right side.

The drive roller 112 rotates the conveyer belt 111 clockwise in FIG. 17.

The following rollers 113 to 115 support the conveyer belt 111 together with the drive roller 112. The following rollers 113 to 115 are rotated by the drive roller 112 via the conveyer belt 111 to follow the drive roller 112. The following roller 113 is arranged on the left side of the drive roller 112 at the same height as the drive roller 112. The following rollers 114 and 115 are arranged below the drive roller 112 and the following roller 113, at the same height while being spaced away from each other in a left-right direction.

The belt motor 116 rotationally drives the drive roller 112.

The sheet suction fan 117 generates a downward air flow. The sheet suction fan 117 thereby aspirates air through the belt holes 111*a* of the conveyer belt 111 and generates negative pressure at the belt holes 111*a* to suck the sheet P on the conveyer belt 111. The sheet suction fan 117 is arranged in a region surrounded by the annular conveyer belt 111.

The guide 103 guides the sheet P conveyed downstream of the conveyer 102. The guide 103 includes paired guide plates 121, 122 and a mist adsorption member 123.

The guide plates 121, 122 are members which guide the sheet P conveyed from the conveyer 102 to a conveyance mechanism (not illustrated) downstream of the conveyer 102.

The mist adsorption member 123 is a member which collects ink mist (satellite droplets) generated by ink ejection from the inkjet heads 136 to be described later by adsorbing the ink mist. The mist adsorption member 123 is installed on the guide plate 121.

The printer 104 performs printing on the sheet P conveyed by the conveyer 102. The printer 104 is arranged above the conveyer 102. The printer 104 includes a head unit 131 and a head cooler 132.

The head unit 131 prints an image by ejecting ink to the sheet P. The head unit 131 includes the multiple inkjet heads 136 and a head holder 137. In the fourth embodiment, the head unit 131 includes four inkjet heads 136.

The inkjet heads 136 eject the ink to the sheet P. The four inkjet heads 136 eject ink of different colors (for example, black, cyan, magenta, and yellow), respectively. The four inkjet heads 136 are arranged parallel to one another in the conveyance direction (left-right direction) of the sheet P. Each inkjet head 136 has multiple head modules 138. In the fourth embodiment, each inkjet head 136 has six head modules 138.

Each head module 138 has an ink chamber (not illustrated) which stores the ink and multiple nozzles (not illustrated) from which the ink is ejected. Piezoelectric elements (not illustrated) are arranged in the ink chamber. The ink is ejected from the nozzles by drive of the piezoelectric elements. The nozzles of the head module 138 are opened on an ejection surface 138*a* which is a lower surface facing the conveyance surface 111*b* of the conveyer belt 111. The nozzles are arranged in the front-rear direction (main scanning direction).

In each inkjet head 136, the head modules 138 are arranged in the front-rear direction while zigzagging. Specifically, in each inkjet head 136, the six head modules 138 are arranged in the front-rear direction with their positions in the left-right direction alternately shifted.

The head modules 138 eject, from the nozzles, the ink supplied by an ink circulation mechanism (not illustrated) provided for each inkjet head 136. The ink circulation mechanism is a mechanism which supplies the ink to the head modules 138 of the inkjet head 136 while circulating the ink. The ink is supplied to the ink circulation mechanism from an ink cartridge (not illustrated).

The head holder 137 holds the inkjet heads 136. The head holder 137 is formed of a hollow box body. The head holder 137 is arranged above the conveyer 102. As illustrated in FIGS. 19 and 20, attachment opening portions 137*b* to which the head modules 138 of the inkjet heads 136 are attached are formed in a bottom plate 137*a* of the head holder 137. As many attachment opening portions 137*b* as the head modules 138 are formed in the bottom plate 137*a* of the head holder 137. The head holder 137 holds the head modules 138 with lower end portions of the head modules 138 protruding downward from the attachment opening portions 137*b*.

Each of the attachment opening portions 137*b* is a through hole larger than a cross-sectional area of the head module 138 along a horizontal plane. The attachment position and angle of the head module 138 are thus adjustable. Since the attachment opening portion 137*b* has such a size, the head module 138 is attached to the attachment opening portion 137*b* with a gap 140 therebetween.

The head holder 137 is provided with sealing members 141. The sealing members 141 are members which close the gaps 140 between the head modules 138 and the attachment opening portions 137*b*.

The head cooler 132 generates cooling air in the head holder 137 and cools the inkjet heads 136 with this cooling air. The head cooler 132 includes a blower 146 and an aspirator 147.

The blower 146 blows air from the outside to the inside of the head holder 137. The blower 146 is arranged on the front side of the head holder 137. The blower 146 includes a blowing chamber 151 and a blowing fan 152.

The blowing chamber 151 forms a flow passage of air between the blowing fan 152 and the head holder 137. The blowing chamber 151 is formed in a hollow shape elongating in the left-right direction. The blowing chamber 151 is arranged on a front side plate of the head holder 137.

Multiple blowing holes (not illustrated) are formed on a surface of the blowing chamber 151 in contact with the head holder 137. The blowing holes of the blowing chamber 151 are ports through which air flows out from the blowing chamber 151 when air is blown into the head holder 137. The blowing holes of the blowing chamber 151 are arranged at positions corresponding to air passage holes (not illustrated) formed in the front side plate of the head holder 137. Air can be thereby blown from the blower 146 into the head holder 137.

The blowing fan 152 sends air from one end of the blowing chamber 151 into the blowing chamber 151. Air is thereby blown into the head holder 137 via the blowing chamber 151.

The aspirator 147 aspirates air from the head holder 137. The aspirator 147 is arranged on the rear side of the head holder 137. The aspirator 147 includes an aspiration chamber 153 and an aspiration fan 154.

The aspiration chamber 153 forms a flow passage of air between the head holder 137 and the aspiration fan 154. The aspiration chamber 153 is formed in a hollow shape elongating in the left-right direction. The aspiration chamber 153 is arranged on a rear side plate of the head holder 137.

Multiple aspiration holes (not illustrated) are formed on a surface of the aspiration chamber 153 in contact with the head holder 137. The aspiration holes of the aspiration chamber 153 are ports through which air flows into the aspiration chamber 153 when air is aspirated from the head holder 137. The aspiration holes of the aspiration chamber 153 are arranged at positions corresponding to air passage holes (not illustrated) formed in the rear side plate of the head holder 137. The aspirator 147 can thereby aspirate air from the head holder 137.

The aspiration fan 154 aspirates air from one end of the aspiration chamber 153. Air is thus aspirated from the head holder 137 via the aspiration chamber 153.

The controller 105 controls operations of the units in the inkjet printer 101. The controller 105 includes a CPU, a RAM, a ROM, a hard disk drive, and the like.

The controller 105 stores a sheet suction fan drive table 156 illustrated in FIG. 22. The sheet suction fan drive table 156 is a table in which the surface tensions of the ink to be ejected by the inkjet heads 136 are associated with duty ratios (drive ratios) of a drive signal of the sheet suction fan 117. In the sheet suction fan drive table 156 of FIG. 22, duty ratios D1, D2, . . . satisfy relationships of D1>D2> . . . .

In this case, the higher the duty ratio of the drive signal of the sheet suction fan 117 is, the higher the number of revolutions of the sheet suction fan 117 is. Moreover, as described later, the higher the number of revolutions of the sheet suction fan 117 is, the stronger the air flows in under-heads spaces 157 are, the under-head spaces 157 being spaces between the conveyance surface 111*b* and the inkjet heads 136. In the fourth embodiment, the sheet suction fan 117 has a function of an adjuster which adjusts the strengths of air flows in the under-head spaces.

In the case of performing a printing operation, the controller 105 sets the duty ratio of the drive signal of the sheet suction fan 117 based on the surface tension of the ink to be ejected by the inkjet heads 136, by referring to the sheet suction fan drive table 156. Specifically, in the printing operation, the controller 105 controls the sheet suction fan 117 such that the lower the surface tension of the ink to be ejected by the inkjet heads 136 is, the stronger the air flows in the under-head spaces 157 are.

Next, operations of the inkjet printer 101 are described.

When a print job is inputted, the controller 105 starts drive of the conveyer 102. Specifically, the controller 105 starts drive of the drive roller 112 by using the belt motor 116. Circulation drive of the conveyer belt 111 is thereby started.

Moreover, the controller 105 starts drive of the sheet suction fan 117. In this case, the controller 105 drives the sheet suction fan 117 at the duty ratio corresponding to the surface tension of the ink to be ejected by the inkjet heads 136.

Specifically, the controller 105 obtains the surface tension of the ink in each inkjet head 136 from, for example, a memory tag provided in the ink cartridge. Note that the surface tension of the ink in each inkjet head 136 sometimes changes due to change in the type or the like of the ink corresponding to the inkjet head 136.

After obtaining the surface tension of the ink in each inkjet head 136, the controller 105 calculates an average value of the surface tensions of the ink in all inkjet heads 136. The controller 105 sets the average value as the surface tension of the ink to be ejected by the inkjet heads 136 and obtains the duty ratio corresponding to this surface tension from the sheet suction fan drive table 156. Then, the controller 105 drives the sheet suction fan 117 at the duty ratio obtained from the sheet suction fan drive table 156. The sheet suction fan 117 is thereby driven such that the lower the surface tension of the ink to be ejected by the inkjet heads 136 is, the higher the number of revolutions of the sheet suction fan 117 is.

The drive of the sheet suction fan 117 causes air to be aspirated through the belt holes 111*a* of the conveyer belt 111 and generates negative pressure at the belt holes 111*a* and the sucking force is generated.

Furthermore, the controller 105 starts drive of the blowing fan 152 and the aspiration fan 154 in the head cooler 132. The drive of the blowing fan 152 causes air to be blown into the head holder 137 via the blowing chamber 151. Moreover, the drive of the aspiration fan 154 causes air to be aspirated from the head holder 137 via the aspiration chamber 153. The cooling air flowing from the front side to the rear side is thereby generated in the head holder 137.

When the drive of the conveyer 102 and the head cooler 132 is started, as many sheets P as the sheets to be printed in the print job are fed to the conveyer 102 one by one. The fed sheets P are conveyed while being sucked and held on the conveyer belt 111 of the conveyer 102. In the conveyer 102, the sheets P are conveyed at predetermined sheet intervals. The controller 105 prints images by causing the head modules 138 of the inkjet heads 136 to eject the ink to the sheets P conveyed by the conveyer belt 111.

Figure 23:
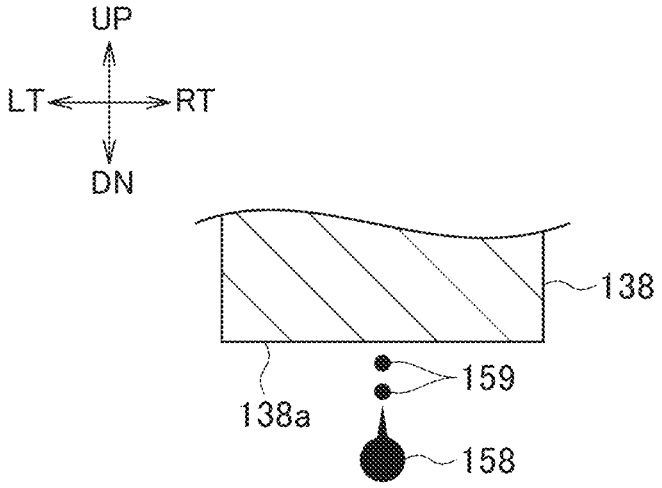
FIG. 23 is an explanatory view of satellite droplets according to the fourth embodiment.

When the ink is ejected from the nozzles of the head modules 138, the ejected ink flies while forming a tail and there are a time difference and a speed difference between a front head portion and a rear tail portion of the flying ink. Accordingly, as illustrated in FIG. 23, satellite droplets 159 which are unnecessary fine droplets are formed to accompany a main droplet 158 which is a preceding main droplet. When the satellite droplets 159 adhere to the sheet P, the satellite droplets 159 cause smear on a printed sheet.

Figure 24:
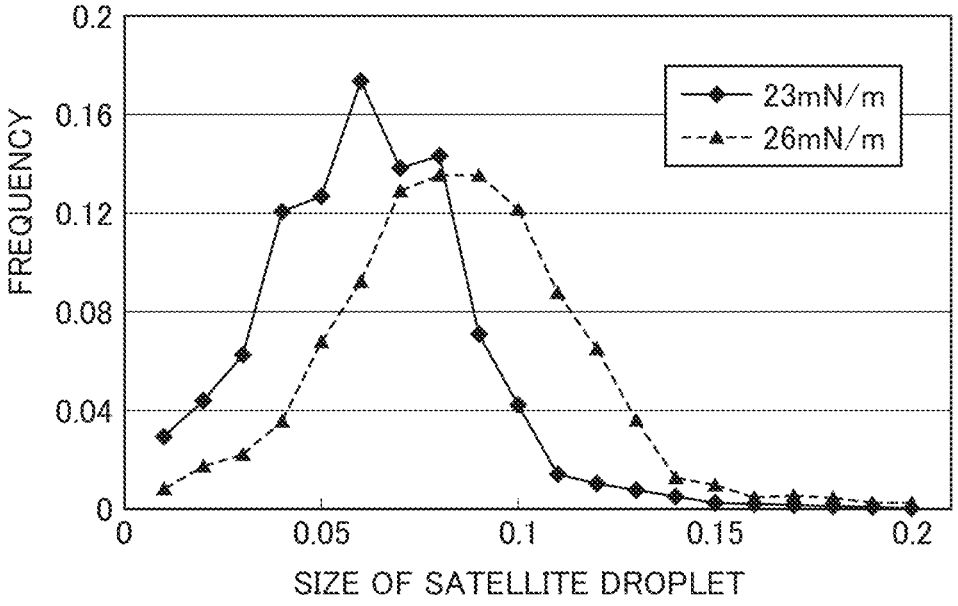
FIG. 24 is a graph illustrating an example of distribution of the size of the satellite droplets at each surface tension of the ink according to the fourth embodiment.

The size of the satellite droplets is affected by the surface tension of the ink. FIG. 24 illustrates an example of distribution of the size of the satellite droplets at each surface tension of the ink. FIG. 24 is a graph formed by obtaining the numbers and sizes of satellite droplets in the ink ejection by means of image analysis and presenting them as a histogram. The sizes of the satellite droplets are based on the size of the main droplet 158 which is not affected by the surface tension of the ink. As illustrated in FIG. 24, there is a tendency that the lower the surface tension of the ink is, the finer the satellite droplets are.

The smaller the satellite droplets are, the more likely the satellite droplets are to be swept away by an air flow. Accordingly, in the inkjet printer 101, in the printing operation, the air flows in the under-head spaces 157 are adjusted such that the lower the surface tension of the ink is, the stronger the air flows in the under-head spaces 157 are to blow away the fine satellite droplets and prevent them from adhering to the sheet P.

Specifically, as described above, the controller 105 sets the duty ratio of the drive signal of the sheet suction fan 117 such that the lower the surface tension of the ink to be ejected by the inkjet heads 136 is, the higher the number of revolutions of the sheet suction fan 117 is.

Figure 25:
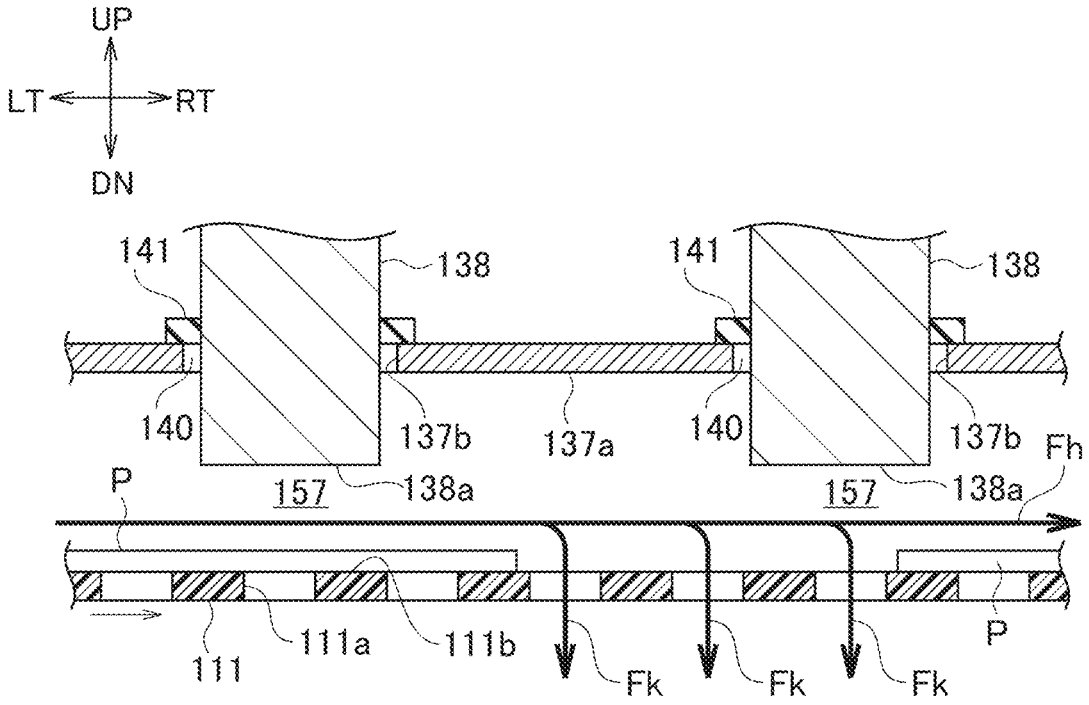
FIG. 25 is an explanatory view of an air flow in an under-head space in the fourth embodiment.

In this case, in the printing operation, as illustrated in FIG. 25, a conveyance air flow Fh is generated in the under-head spaces 157. The conveyance air flow Fh is an air flow generated by movement of the conveyer belt 111 and the sheet P. The conveyance air flow Fh flows in the conveyance direction of the sheet P.

Moreover, in a sheet interval region between the conveyed sheet P and sheet P, there is no sheet P on the belt holes 111*a* and the belt holes 111*a* are exposed. Accordingly, aspiration air flows Fk are generated. The aspiration air flows Fk are air flows flowing from a space above the conveyance surface 111*b* to an inside of the conveyer 102 through the belt holes 111*a* by the drive of the sheet suction fan 117.

The higher the duty ratio of the drive signal of the sheet suction fan 117 is, the higher the number of revolutions of the sheet suction fan 117 is, and the stronger the aspiration air flows Fk are. When the aspiration air flows Fk become stronger, a combined air flow of the conveyance air flow Fh and the aspiration air flows Fk becomes stronger and thus the air flows in the under-head spaces 157 become stronger.

Accordingly, the lower the surface tension of the ink to be ejected by the inkjet heads 136 is, the stronger the air flows in the under-head spaces 157 can be made by increasing the number of revolutions of the sheet suction fan 117.

The air flows thereby blow away the fine satellite droplets and prevent them from adhering to the sheet P when the surface tension of the ink is relatively low and the mist smear on the printed sheet is thereby reduced.

The satellite droplets blown away by the air flow float as ink mist and are collected by being carried by the aspiration air flows Fk and aspirated into the conveyer 102 or by being adsorbed by the mist adsorption member 123.

In this case, large satellite droplets are less likely to be affected by the air flow. Accordingly, when the air flow is made stronger, the large satellite droplets are sometimes not sufficiently blown away and are instead incompletely swept away to land at positions away from the landing position of the main droplet on the sheet P. As a result, the satellite droplets sometimes land in a white portion (no-print area) of the sheet P and cause mist smear. When the air flow is sufficiently weak relative to the size of the satellite droplets, the satellite droplets land on a dot formed by the landed main droplet and mist smear on the printed sheet is suppressed.

Setting the duty ratio of the drive signal of the sheet suction fan 117 as described above causes the air flows in the under-head spaces 157 to be such that the higher the surface tension of the ink is, the weaker the air flows are. Accordingly, the mist smear caused by landing of relatively-large satellite droplets in a white portion of the sheet P is also reduced.

Figure 26:
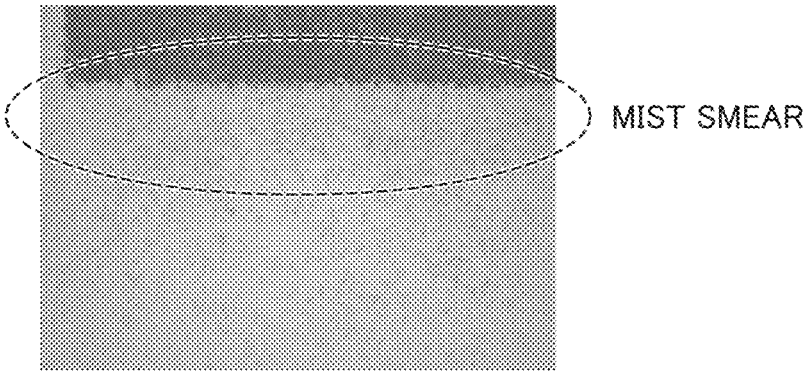
FIG. 26 is a view illustrating mist smear on a printed sheet in the fourth embodiment.
Figure 27:
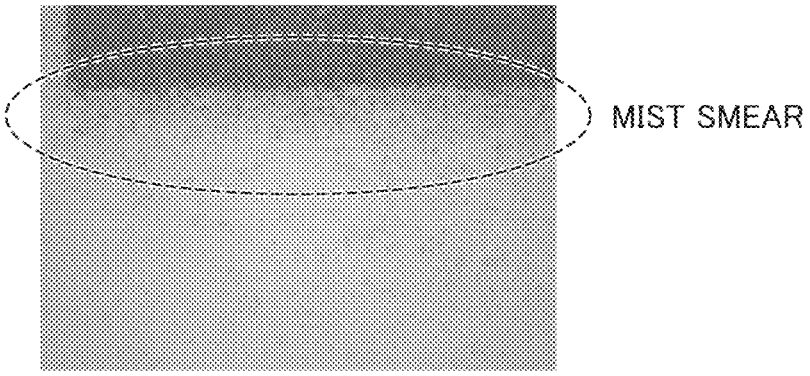
FIG. 27 is a view illustrating mist smear on a printed sheet in a comparative example.

FIG. 26 illustrates an example of the mist smear on the printed sheet in the case where the sheet suction fan 117 is driven as described above. Moreover, as a comparative example, FIG. 27 illustrates an example of the mist smear on the printed sheet in the case where the sheet suction fan 117 is driven at a predetermined duty ratio irrespective of the surface tension of the ink. The mist smear in the example of FIG. 26 according to the fourth embodiment is suppressed more than the mist smear in the comparative example of FIG. 27.

The sheets P subjected to printing by the printer 104 are conveyed by the conveyance mechanism (not illustrated) downstream of the conveyer 102 while being guided by the guide plates 121, 122 and are discharged. When the last sheet P is discharged, the controller 105 stops the drive roller 112 and stops the sheet suction fan 117. Moreover, the controller 105 stops the blowing fan 152 and the aspiration fan 154. The series of operations is thereby completed.

As described above, in the inkjet printer 101, the controller 105 controls the sheet suction fan 117 such that the lower the surface tension of the ink to be ejected by the inkjet heads 136 is, the stronger the air flows in the under-head spaces 157 are. This can suppress landing of relatively large satellite droplets in a white portion of the sheet P when the surface tension of the ink is relatively high, and also cause the air flows to blow away fine satellite droplets and prevent them from adhering to the sheet P when the surface tension of the ink is relatively low. As a result, the mist smear on the printed sheet can be reduced.

Next, a fifth embodiment partially changed from the fourth embodiment is described.

Figure 28:
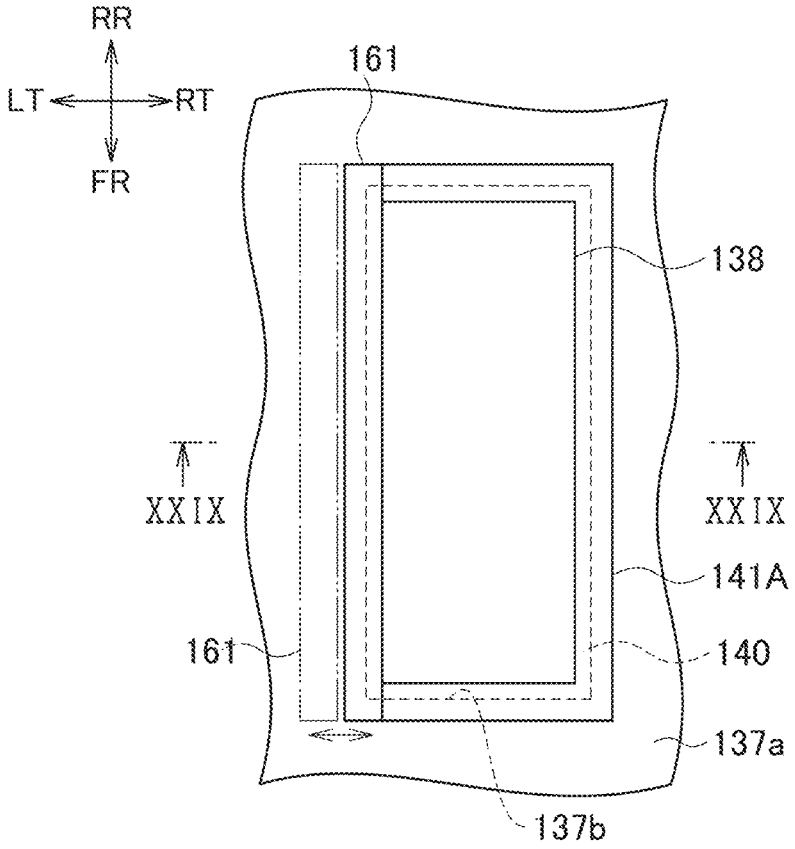
FIG. 28 is a plan view of a portion around a head module of a printer in a fifth embodiment.
Figure 29:
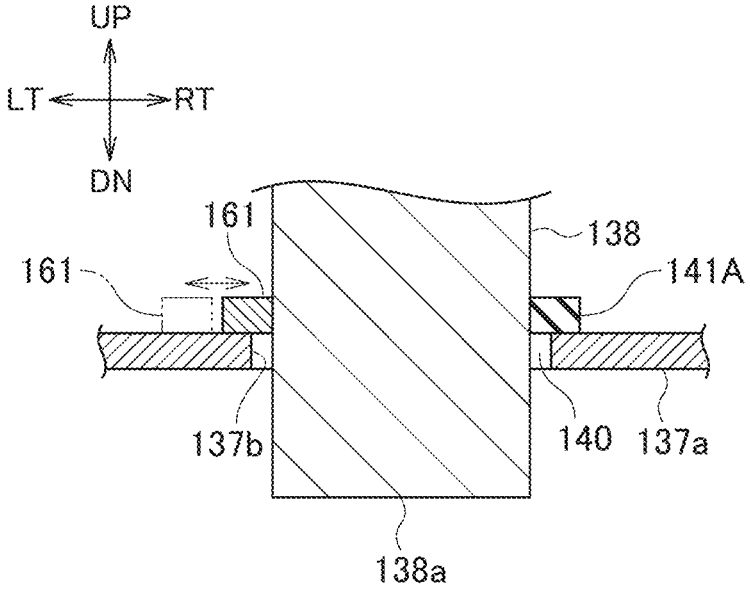
FIG. 29 is a cross-sectional view taken along the line XXIX-XXIX in FIG. 28.

FIG. 28 is a plan view of a portion around the head module 38 of a printer in the fifth embodiment. FIG. 29 is a cross-sectional view taken along the line XXIX-XXIX in FIG. 28.

In the fifth embodiment, the printer 104 has a configuration in which, as illustrated in FIGS. 28 and 29, the sealing members 141 in the fourth embodiment are replaced by sealing members 141A and shutters 161 are added.

Each shutter 161 opens and closes part of the corresponding gap 140. In the fifth embodiment, each shutter 161 opens and closes a portion of the corresponding gap 140 extending along a left side surface of the corresponding head module 138. When the shutters 161 open, the cooling air in the head holder 137 leaks out and flows to the under-head spaces 157 through the gaps 140 and the air flows in the under-head spaces 157 become strong. The shutters 161 have a function of an adjuster capable of individually adjusting the strengths of the air flows in the under-head spaces 157 of the respective inkjet heads 136.

The sealing member 141A is a member which closes a portion of the gap 140 other than the portion opened and closed by the shutter 161.

In the fifth embodiment, in the printing operation, for each inkjet head 136, the controller 105 controls the shutters 161 corresponding to the head modules 138 in the inkjet head 136 such that the lower the surface tension of the ink to be ejected by the inkjet head 136 is, the stronger the air flow in the under-head space 157 of the inkjet head 136 is.

Figure 30:
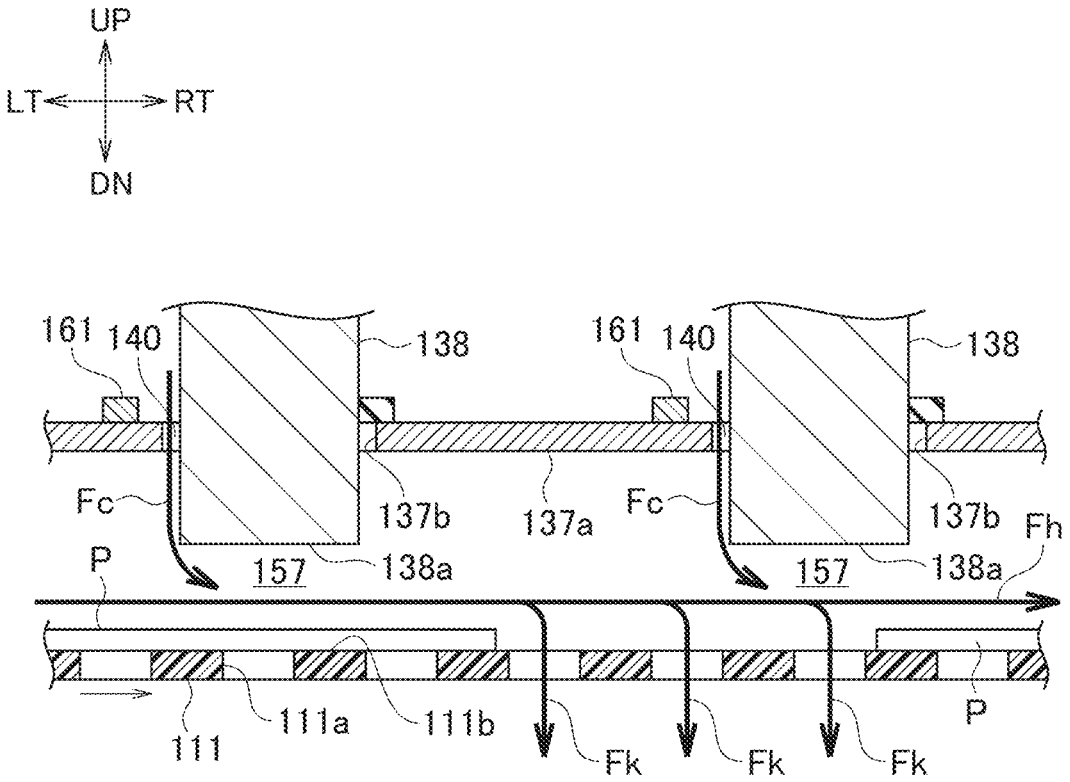
FIG. 30 is an explanatory view of an air flow in an under-head space in the fifth embodiment.

In this case, when the shutters 161 are open in the printing operation, as illustrated in FIG. 30, cooling leaking air flows Fc flow to the under-head space 157. The cooling leaking air flows Fc are the cooling air in the head holder 137 leaking from the gaps 140. When the cooling leaking air flows Fc flow to the under-head space 157, the air flow in the under-head space 157 becomes stronger than that in the case where the shutters 161 are closed. Moreover, the strength of the air flow in the under-head space 157 can be adjusted by intermittently opening and closing the shutters 161 to adjust the opening-closing cycles of the opening-closing operation and the opening time in one cycle.

Thus, for each inkjet head 136, the controller 105 performs control of setting the shutters 161 to the open state, setting the shutters 161 to the closed state, or performing the intermittent opening-closing operation of the shutters 161 such that the lower the surface tension of the ink is, the stronger the air flow in the under-head space 157 of the inkjet head 136 is. Moreover, when performing the intermittent opening-closing operation of the shutters 161, the controller 105 controls the opening-closing cycles and the opening time in one cycle such that the lower the surface tension of the ink is, the stronger the air flow in the under-head space 157 is. The contents of the opening-closing control of the shutters 161 corresponding to the surface tension of the ink are set in advance such that the air flow in the under-head space 157 flows at the strength corresponding to the surface tension of the ink.

As described above, in the fifth embodiment, for each inkjet head 136, the controller 105 controls the shutters 161 corresponding to the head modules 138 in the inkjet head 136 such that the lower the surface tension of the ink to be ejected by the inkjet head 136 is, the stronger the air flow in the under-head space 157 of the inkjet head 136 is. For each inkjet head 136, the strength of the air flow in the under-head space 157 of the inkjet head 136 can be thereby adjusted depending on the surface tension of the ink. Accordingly, the mist smear on the printed sheet can be further reduced.

Next, a sixth embodiment partially changed from the fourth embodiment is described.

Figure 31:
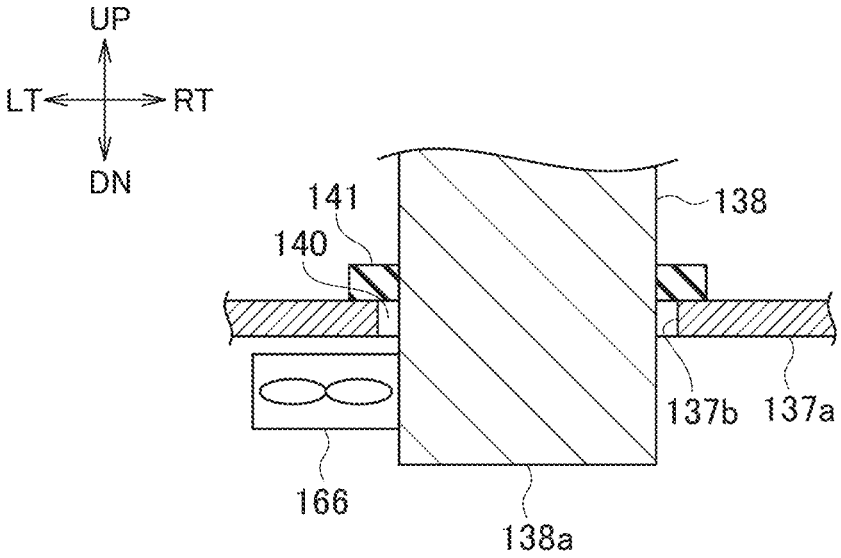
FIG. 31 is a cross-sectional view of a portion around a head module of a printer in a sixth embodiment.

FIG. 31 is a cross-sectional view of a portion around the head module 138 in a printer in the sixth embodiment.

In the sixth embodiment, the printer 104 has a configuration in which, as illustrated in FIG. 31, air flow adjustment fans 166 are added to the printer 104 of the fourth embodiment.

The air flow adjustment fans 166 are provided near the respective head modules 138 in one to one correspondence with the head modules 138. The air flow adjustment fans 166 generate downward air flows. The stronger the air flows generated by the air flow adjustment fans 166 are, the stronger the air flows in the under-head spaces 157 is. The air flow adjustment fans 166 have a function of an adjuster capable of individually adjusting the strengths of the air flows in the under-head spaces 157 of the respective inkjet heads 136.

In the sixth embodiment, in the printing operation, for each inkjet head 136, the controller 105 controls the air flow adjustment fans 166 corresponding to the head modules 138 in the inkjet head 136 such that the lower the surface tension of the ink to be ejected by the inkjet head 136 is, the stronger the air flow in the under-head space 157 of the inkjet head 136 is.

Figure 32:
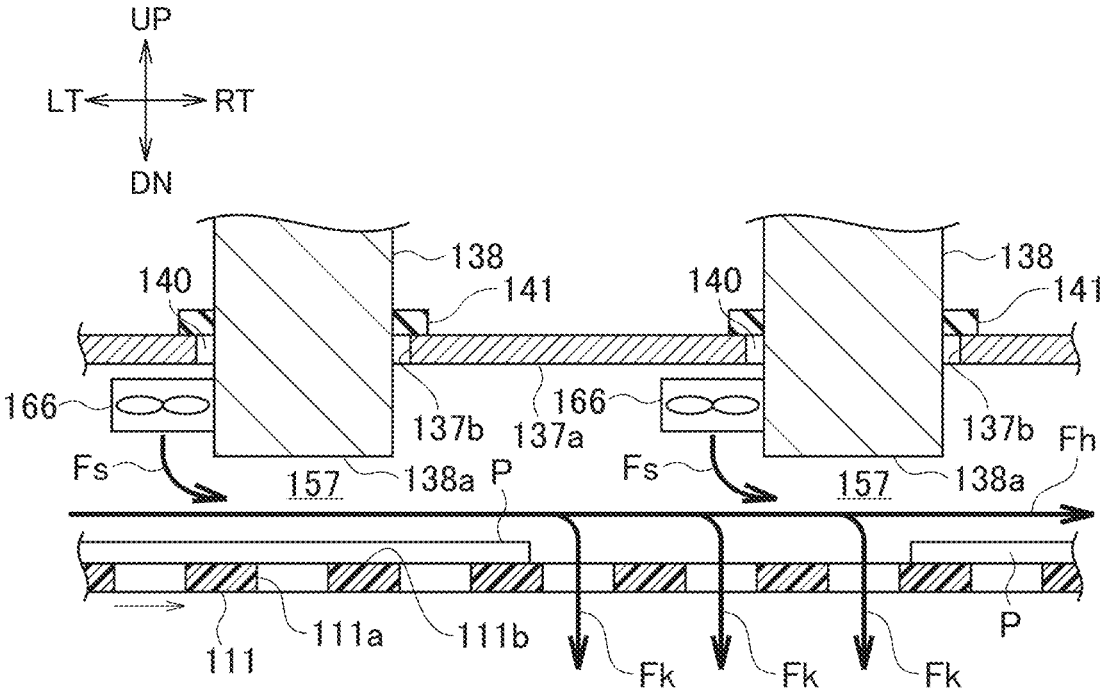
FIG. 32 is an explanatory view of an air flow in an under-head space in the sixth embodiment.

In this case, when the air flow adjustment fans 166 are driven in the printing operation, as illustrated in FIG. 32, adjustment air flows Fs generated by the air flow adjustment fans 166 flow to the under-head space 157. When the adjustment air flows Fs flows to the under-head space 157, the air flow in the under-head space 157 becomes stronger than that in the case where the air flow adjustment fans 166 are stopped. Moreover, the stronger the adjustment air flows Fs are, the stronger the air flow in the under-head space 157 is.

Accordingly, the lower the surface tension of the ink is, the stronger the air flow in the under-head space 157 can be made by increasing a duty ratio of a drive signal of the air flow adjustment fans 166 and making the adjustment air flows Fs stronger. The duty ratio of the drive signal of the air flow adjustment fans 166 corresponding to the surface tension of the ink is set in advance such that the air flow in the under-head space 157 flows at the strength corresponding to the surface tension of the ink.

As described above, in the sixth embodiment, for each inkjet head 136, the controller 105 controls the air flow adjustment fans 166 corresponding to the head modules 138 in the inkjet head 136 such that the lower the surface tension of the ink to be ejected by the inkjet head 136 is, the stronger the air flow in the under-head space 157 of the inkjet head 136 is. For each inkjet head 136, the strength of the air flow in the under-head space 157 of the inkjet head 136 can be thereby adjusted depending on the surface tension of the ink as in the fifth embodiment. Accordingly, the mist smear on the printed sheet can be reduced.

In the fifth embodiment, the shutters 161 in each inkjet head 136 are controlled such that the lower the surface tension of the ink is, the stronger the air flow in the under-head space 157 of the inkjet head 136 is. However, the shutters 161 may be controlled to adjust the strength of the air flow in the under-head space 157 based on the average value of the surface tensions of the ink in all inkjet heads 136 as in the fourth embodiment. Also in the sixth embodiment, the air flow adjustment fans 166 may be controlled to adjust the strength of the air flow in the under-head space 157 based on the average value of the surface tensions of the ink in all inkjet heads 136 as in the fourth embodiment.

Moreover, the strengths of the air flows in the under-head spaces 157 may be adjusted by combining the control of the shutters 161 in the fifth embodiment and the control of the air flow adjustment fans 166 in the sixth embodiment. Furthermore, the strengths of the air flows in the under-head spaces 157 may be adjusted by combining the control of the sheet suction fan 117 in the fourth embodiment with at least one of the control of the shutters 161 in the fifth embodiment and the control of the air flow adjustment fans 166 in the sixth embodiment.

Moreover, in the fifth embodiment, the head holder 137 may be configured to be sectioned into parts for the respective inkjet heads 136 and have head coolers configured to generate cooling air for the respective inkjet heads 136. Furthermore, in this configuration, for each inkjet head 136, the strength of the air flow in the under-head space 157 of the inkjet head 136 may be adjusted by combining adjustment of the strength of the cooling air for the inkjet head 136 and the control of the shutters 161. Moreover, the air flow adjustment fans 166 of the sixth embodiment may be added to this configuration and, for each inkjet head 136, the strength of the air flow in the under-head space 157 of the inkjet head 136 may be adjusted by combining the adjustment of the strength of the cooling air for the inkjet head 136, the control of the shutters 161, and the control of the air flow adjustment fans 166.

Moreover, in the fifth embodiment, the configuration may be such that the shutters 161 are configured to be capable of adjusting the opening areas of the gaps 140 and the strength of the air flow in the under-head space 157 is adjusted by adjusting the opening areas of the gaps 140.

Furthermore, although the configuration in which the strength of the air flow in each under-head space 157 is adjusted by using the air flow adjustment fans 166 configured to generate the downward air flows is described in the sixth embodiment, the strength of the air flow in the under-head space 157 may be adjusted by using fans configured to generate upward air flows.

Moreover, in the fifth and sixth embodiments, the conveyer 102 is not limited to an air aspiration type conveyer and may be a conveyer of a different type such as an electrostatic adsorption type.

Furthermore, although the configuration including multiple inkjet heads 136 is described in the fourth to sixth embodiments, the configuration may include only one inkjet head 136.

The embodiments have, for example, the following configurations.

An inkjet printer includes: a conveyer configured to convey a print medium; an inkjet head configured to eject ink to the print medium conveyed by the conveyer; a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is.

The controller may be configured to control the flow adjuster such that the lower a surface tension of the ink to be ejected by the inkjet head is, the stronger the air flow in the under-head space is.

The inkjet head may be provided in a plurality. The flow adjuster may be capable of individually adjusting strengths of the air flows in the under-head spaces of the respective inkjet heads. For each of the inkjet heads, the controller may be configured to control the flow adjuster such that the lower the surface tension of the ink to be ejected by the inkjet head is, the stronger the air flow in the under-head space of the inkjet head is.

Figure 33:
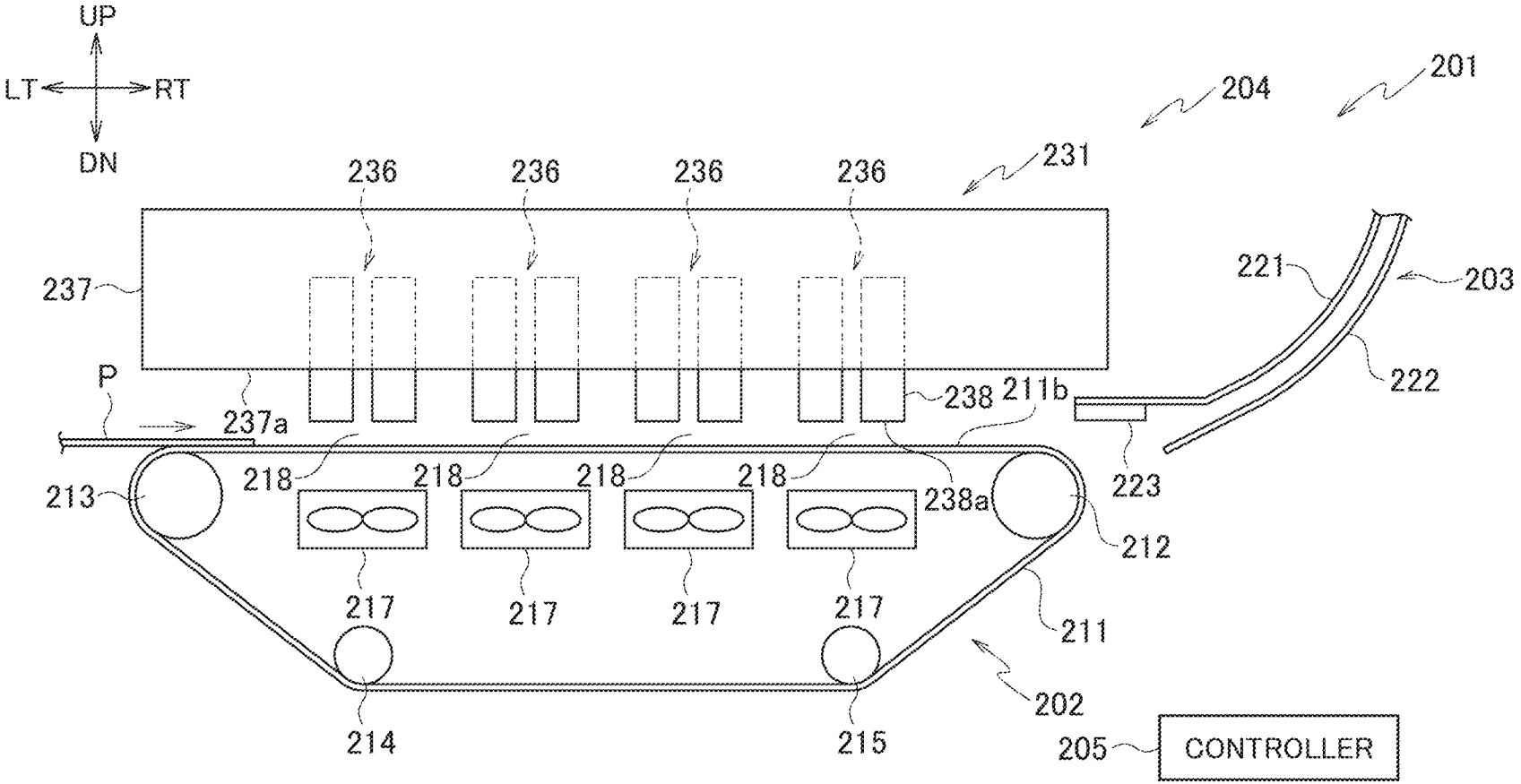
FIG. 33 is a schematic configuration diagram of an inkjet printer according to a seventh embodiment.
Figure 34:
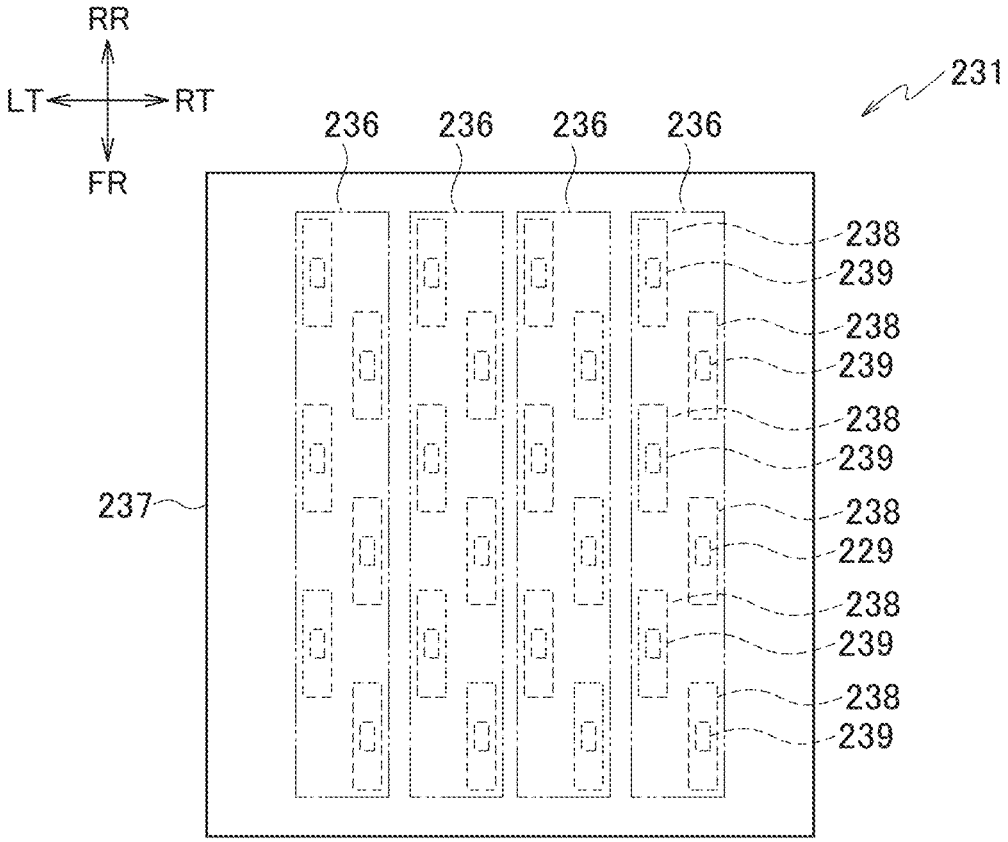
FIG. 34 is a plan view of a head unit of the inkjet printer illustrated in FIG. 33.
Figure 35:
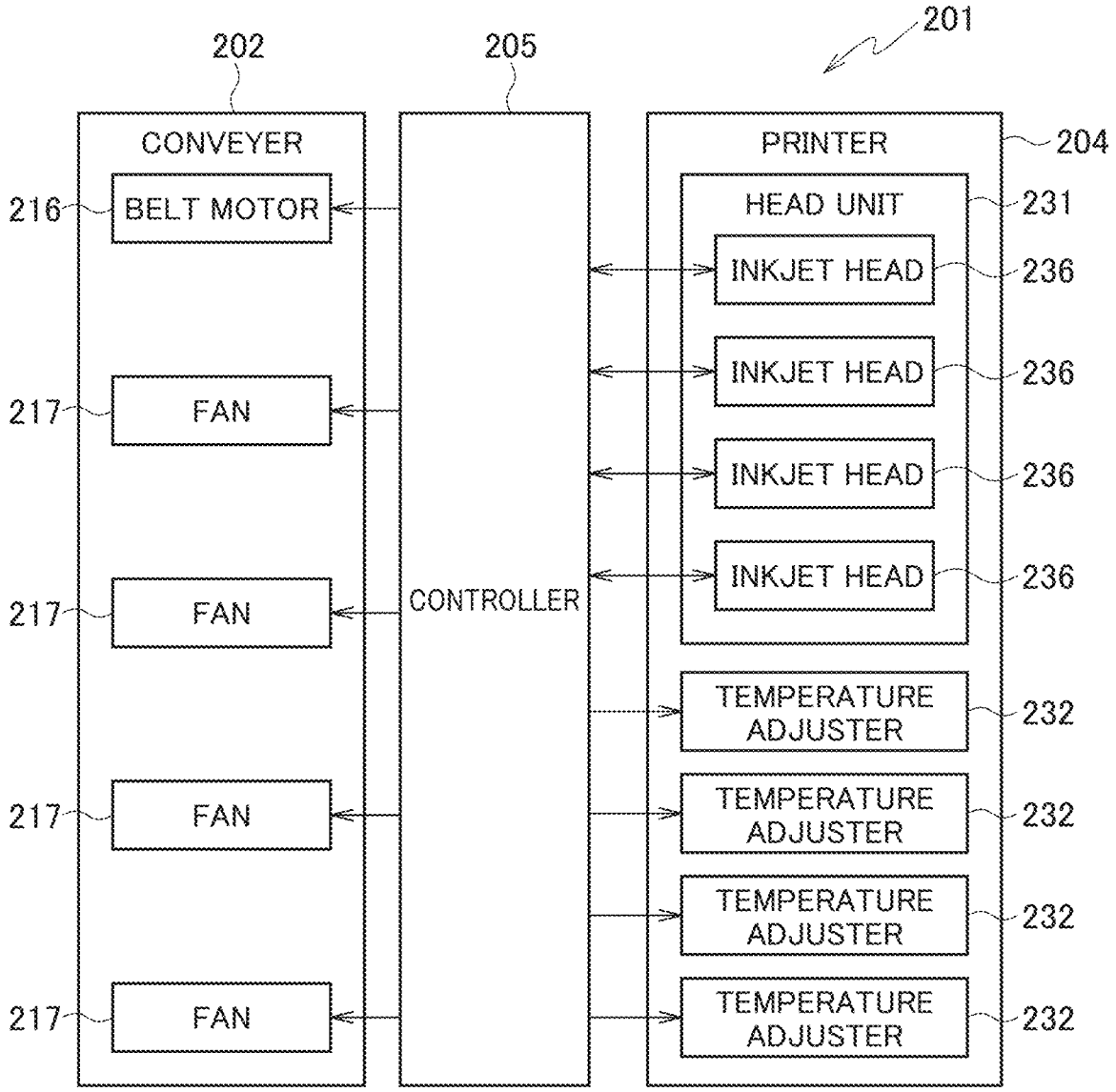
FIG. 35 is a control block diagram of the inkjet printer illustrated in FIG. 33.

Next, a seventh embodiment is described. FIG. 33 is a schematic configuration diagram of an inkjet printer 201 according to a seventh embodiment. FIG. 34 is a plan view of a head unit 231 in the inkjet printer 201 illustrated in FIG. 33. FIG. 35 is a control block diagram of the inkjet printer 201 illustrated in FIG. 33. In the following description, the direction orthogonal to the sheet surface of FIG. 33 is referred to as a front-rear direction. Moreover, up, down, left, and right on the sheet surface of FIG. 33 are referred to as directions of up, down, left, and right. In FIG. 33, the direction from left to right is the conveyance direction of the sheet P which is the print medium. Upstream and downstream in the following description mean upstream and downstream in the conveyance direction of the sheet P. In FIGS. 33, 34, 39, and 41, the directions of right, left, up, down, front, and rear are denoted by RT, LT, UP, DN, FR, and RR, respectively.

As illustrated in FIGS. 33 and 35, the inkjet printer 201 according to the seventh embodiment includes a conveyer 202, a guide 203, a printer 204, and a controller 205.

The conveyer 202 conveys the sheet P fed from a sheet feeder (not illustrated) by means of air aspiration. The conveyer 202 includes a conveyer belt 211, a drive roller 212, following rollers 213 to 215, a belt motor 216, and four fans 217.

The conveyer belt 211 conveys the sheet P while sucking and holding the sheet P. The conveyer belt 211 is an annular belt wound around the drive roller 212 and the following rollers 213 to 215. Multiple belt holes 211*a* (see FIG. 41) are formed in the conveyer belt 211. The conveyer belt 211 sucks and holds the sheet P on a conveyance surface 211*b* by using sucking force generated at the belt holes 211*a* by drive of the fans 217. The conveyance surface 211*b* is an upper surface of a horizontal portion of the conveyer belt 211 between the drive roller 212 and the following roller 213. The conveyer belt 211 is rotated clockwise in FIG. 33 to convey the sucked and held sheet P toward the right side.

The drive roller 212 rotates the conveyer belt 211 clockwise in FIG. 33.

The following rollers 213 to 215 support the conveyer belt 211 together with the drive roller 212. The following rollers 213 to 215 are rotated by the drive roller 212 via the conveyer belt 211 to follow the drive roller 212. The following roller 213 is arranged on the left side of the drive roller 212 at the same height as the drive roller 212. The following rollers 214 and 215 are arranged below the drive roller 212 and the following roller 213, at the same height while being spaced away from each other in a left-right direction.

The belt motor 216 rotationally drives the drive roller 212.

The fans 217 generate downward air flows. The fans 217 thereby aspirate air through the belt holes 211*a* of the conveyer belt 211 and generate negative pressure at the belt holes 211*a* to suck the sheet P on the conveyer belt 211. The fans 217 are arranged in a region surrounded by the annular conveyer belt 211.

The four fans 217 are provided to correspond respectively to four inkjet heads 236 to be described later. As described later, the higher the number of revolutions of the fans 217 is, the stronger the air flows in under-head spaces 218 are, the under-head spaces 218 being spaces between the conveyance surface 211*b* and the inkjet heads 236. The fans 217 have a function of a flow adjuster which adjusts the strengths of air flows in the under-head spaces 218.

Note that multiple fans 217 may be provided for each inkjet head 236.

The guide 203 guides the sheet P conveyed downstream of the conveyer 202. The guide 203 includes paired guide plates 221, 222 and a mist adsorption member 223.

The guide plates 221, 222 are members which guide the sheet P conveyed from the conveyer 202 to a conveyance mechanism (not illustrated) downstream of the conveyer 202.

The mist adsorption member 223 is a member which collects ink mist (satellite droplets) generated by ink ejection from the inkjet heads 236 to be described later by adsorbing the ink mist. The mist adsorption member 223 is installed on the guide plate 221.

The printer 204 performs printing on the sheet P conveyed by the conveyer 202. The printer 204 includes a head unit 231 and four temperature adjusters 232.

The head unit 231 prints an image by ejecting ink to the sheet P. The head unit 231 includes the multiple inkjet heads 236 and a head holder 237. In the seventh embodiment, the head unit 231 includes four inkjet heads 236.

The inkjet heads 236 eject the ink to the sheet P. The four inkjet heads 236 eject ink of different colors (for example, black, cyan, magenta, and yellow), respectively. The four inkjet heads 236 are arranged parallel to one another in the conveyance direction (left-right direction) of the sheet P, above the conveyer 202. Each inkjet head 236 has multiple head modules 238. In the seventh embodiment, each inkjet head 236 has six head modules 238.

Each head module 238 has an ink chamber (not illustrated) which stores the ink and multiple nozzles (not illustrated) from which the ink is ejected. Piezoelectric elements (not illustrated) are arranged in the ink chamber. The ink is ejected from the nozzles by drive of the piezoelectric elements. The nozzles of the head module 238 are opened on an ejection surface 238*a* which is a lower surface facing the conveyance surface 211*b* of the conveyer belt 211. The nozzles are arranged in the front-rear direction (main scanning direction).

Each head module 238 is a multi-drop type head module which can eject multiple ink droplets per pixel from each nozzle and performs gradation printing in which density is expressed depending on a drop number (ejection amount) which is the number of ink droplets.

Each head module 238 ejects, from the nozzles, the ink supplied by an ink circulation mechanism (not illustrated) provided for each inkjet head 236. The ink circulation mechanism is a mechanism which supplies the ink to the head modules 238 of the inkjet head 236 while circulating the ink.

In each inkjet head 236, the head modules 238 are arranged in the front-rear direction while zigzagging. Specifically, in each inkjet head 236, the six head modules 238 are arranged in the front-rear direction with their positions in the left-right direction alternately shifted.

Each head module 238 is provided with a temperature sensor 239. The temperature sensor 239 detects ink temperature in the head module 238.

The head holder 237 holds the inkjet heads 236. The head holder 237 is formed of a hollow box body. The head holder 237 is arranged above the conveyer 202. The head holder 237 holds the head modules 238 with lower end portions of the head modules 238 protruding downward from a bottom plate 237*a* of the head holder 237.

The temperature adjusters 232 adjust the ink temperature in the inkjet heads 236. The four temperature adjusters 232 are provided respectively for the four inkjet heads 236. The temperature adjusters 232 are provided, for example, in the aforementioned ink circulation mechanisms.

The controller 205 controls operations of the units in the inkjet printer 201. The controller 205 includes a CPU, a RAM, a ROM, a hard disk drive, and the like.

Figures 36, 37, 38:
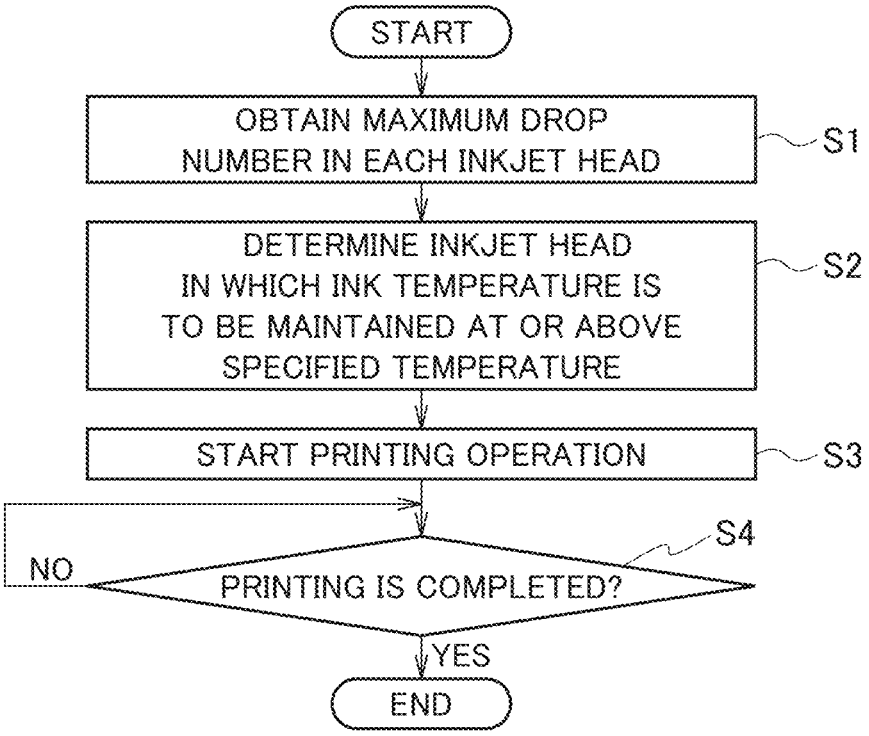
FIG. 36 is a diagram illustrating a first table according to the seventh embodiment.
FIG. 37 is a diagram illustrating a second table according to the seventh embodiment.
FIG. 38 is a flowchart for explaining operations of the inkjet printer according to the seventh embodiment.

The controller 205 stores a first table 241 illustrated in FIG. 36 and a second table 242 illustrated in FIG. 37. The first table 241 and the second table 242 are tables in which the ink temperatures in the inkjet heads 236 are associated with the duty ratios (drive ratios) of drive signals of the fans 217.

The first table 241 is a table used for each inkjet head 236 when a maximum drop number (corresponding to maximum ejection amount) which is the maximum value of ink drop number per pixel in the inkjet head 236 is more than a threshold set in advance. The second table 242 is a table used for each inkjet head 236 when the maximum drop number in the inkjet head 236 is equal to or less than the threshold. In this case, as described later, the threshold of the maximum drop number is set to such a number that, when the drop number is equal to or smaller than this number, the main droplet of the ink is likely to be affected by the air flow.

In the first table 241, duty ratios Da1, Da2, . . . satisfy relationships of Da1>Da2> . . . . In the second table 242, duty ratios Db1, Db2, . . . satisfy relationships of Db1> Db2> . . . .

The higher the duty ratio of the drive signal of each fan 217 is, the higher the number of revolutions of the fan 217 is. Moreover, as described later, the higher the number of revolutions of the fan 217 is, the stronger the air flow in the corresponding under-head space 218 is. In other words, the strength of the air flow in the under-head space 218 is adjusted by controlling the number of revolutions (duty ratio) of the fan 217.

For each inkjet head 236 in which the maximum drop number is more than the threshold, in the printing operation, the controller 205 controls the duty ratio of the drive signal of the fan 217 corresponding to the inkjet head 236 based on the ink temperature in the inkjet head 236 by referring to the first table 241.

Specifically, for each inkjet head 236 in which the maximum drop number is more than the threshold, the controller 205 controls the fan 217 corresponding to the inkjet head 236 based on the first table 241 such that the lower the temperature of the ink is, the stronger the air flow in the under-head space 218 is.

Moreover, for each inkjet head 236 in which the maximum drop number is equal to or less than the threshold, in the printing operation, the controller 205 controls the temperature adjuster 232 corresponding to the inkjet head 236 such that the ink temperature is maintained at or above a specified temperature (corresponding to prescribed temperature) set in advance. Then, the controller 205 controls the duty ratio of the drive signal of the fan 217 corresponding to the inkjet head 236 based on the ink temperature in the inkjet head 236 by referring to the second table 242.

Specifically, for each inkjet head 236 in which the maximum drop number is equal to or less than the threshold, the controller 205 adjusts the ink temperature by using the temperature adjuster 232 such that the ink temperature is maintained at or above the specified temperature and controls the fan 217 corresponding to the inkjet head 236 based on the second table 242 such that the lower the temperature of the ink is, the stronger the air flow in the under-head space 218 is. In this case, as described later, the specified temperature of the ink temperature is set as an ink temperature at which formation of fine satellite droplets can be suppressed.

As described above, when the maximum drop number of the inkjet head 236 is equal to or less than the threshold, the ink temperature adjustment is performed such that the ink temperature is maintained at or above the specified temperature. Accordingly, the second table 242 stores duty ratios in the case where the ink temperature is equal to or higher than the specified temperature. Meanwhile, the first table 241 stores duty ratios in the case where the ink temperature is lower than the specified temperature and is equal to or higher than a lower limit temperature of a suitable temperature range. In other words, Tb1 in the second table 242 of FIG. 37 is a temperature higher than Ta1 in the first table 241 of FIG. 36.

Moreover, in the second table 242, the duty ratio corresponding to each ink temperature is smaller than that in the first table 241. Specifically, when the maximum drop number in the inkjet head 236 is equal to or less than the threshold, the duty ratio corresponding to a certain ink temperature is smaller than the duty ratio corresponding to the same ink temperature in the case where the maximum drop number is more than the threshold. Accordingly, the controller 205 controls the fan 217 corresponding to the inkjet head 236 such that the air flow in the under-head space 218 adjusted depending on the ink temperature in the case where the maximum drop number in the inkjet head 236 is equal to or less than the threshold is weaker than that in the case where the maximum drop number is more than the threshold.

Next, operations of the inkjet printer 201 are described with reference to the flowchart of FIG. 38.

When a print job is inputted, in step S1 of FIG. 38, the controller 205 obtains the maximum drop number in each of the inkjet heads 236 from information included in the print job. The maximum drop number is determined depending on print resolution and the like of each inkjet head 236.

Next, in step S2, the controller 205 determines the inkjet head 236 in which the ink temperature is to be maintained at or above the specified temperature, based on the maximum drop number in each inkjet head 236. Specifically, the controller 205 determines the inkjet head 236 in which the maximum drop number is equal to or less than the threshold as the inkjet head 236 in which the ink temperature is to be maintained at or above the specified temperature.

Next, in step S3, the controller 205 starts the printing operation. Specifically, the controller 205 starts the drive of the drive roller 212 by using the belt motor 216. Circulation drive of the conveyer belt 211 is thereby started. Moreover, the controller 205 starts drive of the fans 217.

In this case, the controller 205 calculates an average value of the detection values of the temperature sensors 239 in the head modules 238 in each inkjet head 236 as the ink temperature in the inkjet head 236. When the ink temperature is lower than the specified temperature in the inkjet head 236 in which the maximum drop number is equal to or less than the threshold, the controller 205 adjusts the ink temperature by using the corresponding temperature adjuster 232 such that the ink temperature reaches or exceeds the specified temperature. Then, the controller 205 obtains the duty ratio corresponding to the ink temperature of each inkjet head 236 by referring to the first table 241 or the second table 242 and drives the corresponding fan 217 at the obtained duty ratio.

The drive of the fan 217 causes air to be aspirated through the belt holes 211*a* of the conveyer belt 211 and sucking force is generated at the belt holes 211*a*.

When the drive of the conveyer 202 is started, the controller 205 causes the not-illustrated sheet feeder to start sheet feeding. As many sheets P as the sheets to be printed in the print job are thereby fed to the conveyer 202 one by one. The fed sheets P are each conveyed while being sucked and held on the conveyer belt 211 of the conveyer 202. In the conveyer 202, the sheets P are conveyed at predetermined sheet intervals. In the conveyer 202, the sheets P are conveyed at predetermined sheet intervals. The controller 205 causes the head modules 238 of the inkjet heads 236 to eject the ink and print images on the sheets P conveyed by the conveyer belt 211.

Figure 39:
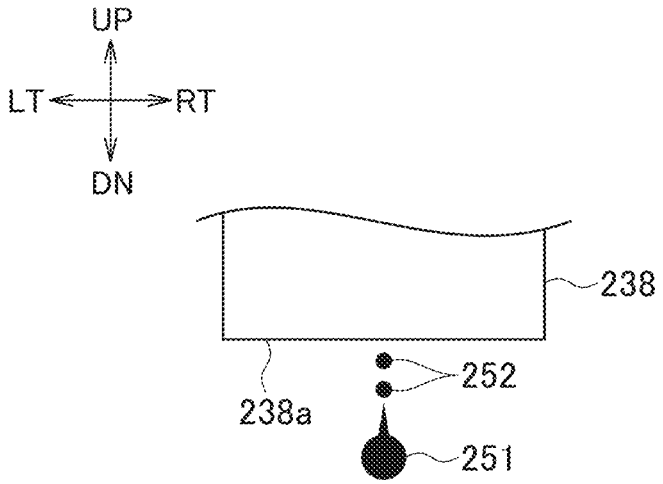
FIG. 39 is an explanatory view of satellite droplets according to the seventh embodiment.

When the ink is ejected from the nozzles of the head modules 38, the ejected ink flies while forming a tail and there are a time difference and a speed difference between a front head portion and a rear tail portion of the flying ink. Accordingly, as illustrated in FIG. 39, satellite droplets 252 which are unnecessary fine droplets are formed to accompany a main droplet 251 which is a preceding main droplet. When the satellite droplets 252 adhere to the sheet P, the satellite droplets 252 cause smearing on a printed sheet. In this case, when the drop number per pixel is more than one, ejected multiple droplets merge while flying and form the main droplet 251.

Figure 40:
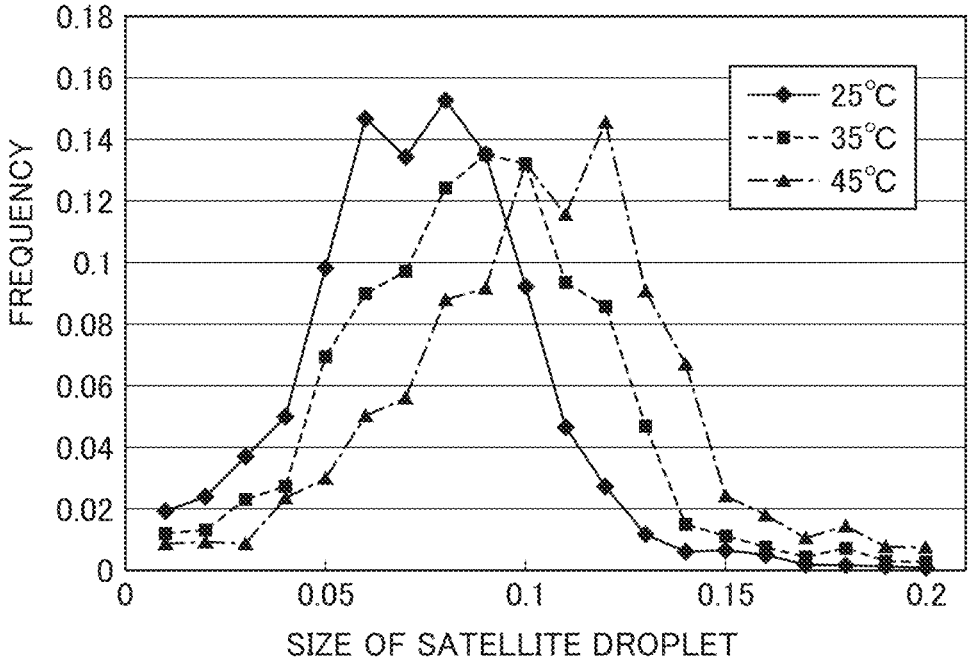
FIG. 40 is a graph illustrating an example of distribution of the size of the satellite droplets at each ink temperature according to the seventh embodiment.

The size of the satellite droplets is affected by the ink temperature. FIG. 40 illustrates an example of distribution of the size of the satellite droplets at each ink temperature. FIG. 40 is a graph formed by obtaining the numbers and sizes of satellite droplets in the ink ejection by means of image analysis and presenting them as a histogram. The sizes of the satellite droplets are based on the size of the main droplet which is not affected by the ink temperature. As illustrated in FIG. 40, there is a tendency that the lower the ink temperature is, the finer the satellite droplets are.

In this case, when the head modules 238 are driven, the head modules 238 generate heat. Temperature rise in the head modules 238 may cause failures and the like. To counter this, in the inkjet printer 201, the temperature rise in the head modules 238 is suppressed by cooling air generated by a not-illustrated head cooling mechanism.

However, even when the head cooling mechanism cools the head modules 238, temperature rise of the ink occurs due to heat generated by the piezoelectric elements in the head modules 238. To counter this, when the ink temperature exceeds an appropriate temperature range, the temperature adjusters 232 cool the ink. Specifically, in the printing operation, the ink temperature changes due to the drive of the head modules 238 and the cooling of the ink by the temperature adjusters 232. Moreover, the ink temperature sometimes changes depending on an environment temperature of a location where the inkjet printer 201 is installed.

When the ink temperature is low, the satellite droplets tend to be fine as described above. The smaller the satellite droplets are, the more likely the satellite droplets are to be swept away by an air flow. Accordingly, in the inkjet printer 201, in the printing operation, the air flows in the under-head spaces 218 are adjusted such that the lower the ink temperature is, the stronger the air flows in the under-head spaces 218 are to blow away the fine satellite droplets and prevent them from adhering to the sheet P.

In this case, when the drop number per pixel is small and the main droplet is small, making the air flow in the under-head space 218 stronger may cause the landing position of the main droplet to deviate and cause a decrease in printed image quality. The smaller the maximum drop number in the inkjet head 236 is, the higher the frequency of ejection at small drop numbers is. Accordingly, the landing position deviation of the main droplet caused by making the air flow in the under-head space 218 stronger is more likely to occur.

Accordingly, in the inkjet printer 201, for each inkjet head 236 in which the maximum drop number is equal to or less than the threshold, the ink temperature adjustment is performed such that the ink temperature reaches or exceeds the specified temperature to reduce the case where fine satellite droplets are formed. In this case, the threshold of the maximum drop number is set to such a number that, when the drop number is equal to or smaller than this number, the main droplet is likely to be affected by the air flow. Moreover, the specified temperature of the ink temperature is set to an ink temperature at which formation of fine satellite droplets can be suppressed.

Moreover, for each inkjet head 236 in which the maximum drop number is equal to or less than the threshold, the fan 217 corresponding to the inkjet head 236 is controlled such that the air flow in the under-head space 218 adjusted depending on the ink temperature is weaker than that in the case where the maximum drop number is more than the threshold.

Specifically, in the printing operation, for each inkjet head 236 in which the maximum drop number is equal to or less than the threshold, the controller 205 controls the temperature adjuster 232 such that the ink temperature is maintained at or above the specified temperature.

Moreover, in the printing operation, the controller 205 calculates the average value of the detection values of the temperature sensors 239 in the head modules 238 in each inkjet head 236 every predetermined time as the ink temperature in the inkjet head 236.

After the calculation of the ink temperature, for each inkjet head 236 in which the maximum drop number is more than the threshold, the controller 205 obtains the duty ratio corresponding to the ink temperature by referring to the first table 241 and controls the drive of the fan 217 at the obtained duty ratio.

For each inkjet head 236 in which the maximum drop number is equal to or less than the threshold, the controller 205 obtains the duty ratio corresponding to the ink temperature by referring to the second table 242 and controls the drive of the fan 217 at the obtained duty ratio.

Figure 41:
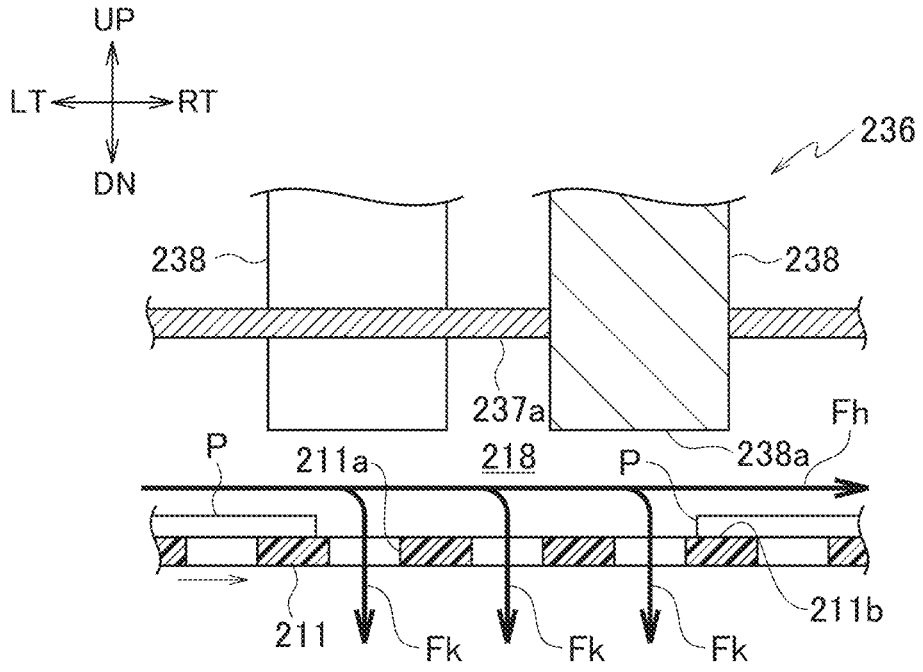
FIG. 41 is an explanatory view of an air flow in an under-head space according to the seventh embodiment.

In this case, in the printing operation, as illustrated in FIG. 41, a conveyance air flow Fh is generated in the under-head spaces 218. The conveyance air flow Fh is an air flow generated by movement of the conveyer belt 211 and the sheet P. The conveyance air flow Fh flows in the conveyance direction of the sheet P.

Moreover, in a sheet interval region between the conveyed sheet P and sheet P, there is no sheet P on the belt holes 211*a* and the belt holes 211*a* are exposed. Accordingly, aspiration air flows Fk are generated. The aspiration air flows Fk are air flows flowing from a space above the conveyance surface 211*b* to an inside of the conveyer 202 through the belt holes 211*a* by the drive of each fan 217.

The higher the duty ratio of the drive signal of the fan 217 is, the higher the number of revolutions of the fan 217 is, and the stronger the aspiration air flows Fk are. When the aspiration air flows Fk become stronger, a combined air flow of the conveyance air flow Fh and the aspiration air flows Fk becomes stronger and thus the air flow in the under-head space 218 becomes stronger.

Accordingly, the controller 205 drives each fan 217 at the duty ratio which corresponds to the ink temperature and which is obtained from the first table 241 or the second table 242 and thereby controls the fan 217 such that the lower the ink temperature is, the stronger the air flow in the under-head space 218 is, in a correspondence relationship between the ink temperature and the strength of the air flow in the under-head space 218 in each of the case where the maximum drop number is more than the threshold and the case where the maximum drop number is equal to or less than the threshold.

The air flow thereby blows away the fine satellite droplets and prevents them from adhering to the sheet P when the ink temperature is relatively low and the mist smear on the printed sheet is thereby reduced.

The satellite droplets blown away by the air flow float as ink mist and are collected by being carried away by the aspiration air flows Fk and aspirated into the conveyer 202 or by being adsorbed by the mist adsorption member 223.

In this case, large satellite droplets are less likely to be affected by the air flow. Accordingly, when the air flow is made stronger, the large satellite droplets are sometimes not sufficiently blown away and are instead incompletely swept away to land at positions away from the landing position of the main droplet on the sheet P. As a result, the satellite droplets sometimes land in a white portion (no-print area) of the sheet P and cause mist smear. When the air flow is sufficiently weak relative to the size of the satellite droplets, the satellite droplets land on a dot formed by the landed main droplet and mist smear on the printed sheet is suppressed.

The aforementioned control of each fan 217 causes the air to flow such that the higher the ink temperature is, the weaker the air flow in the under-head space 218 is. Accordingly, the mist smear caused by landing of relatively-large satellite droplets in a white portion of the sheet P is also reduced.

In this case, in each inkjet head 236 in which the maximum drop number is equal to or less than the threshold, the ink temperature is adjusted to be at or above the specified temperature. Accordingly, there are many relatively-large satellite droplets and few fine satellite droplets. Moreover, as described above, for each inkjet head 236 in which the maximum drop number is equal to or less than the threshold, the fan 217 is controlled such that the air flow in the under-head space 218 adjusted depending on the ink temperature is weaker than that in the case where the maximum drop number is more than the threshold.

Accordingly, in each inkjet head 236 in which the maximum drop number is equal to or less than the threshold, the case where relatively-large satellite droplets land at positions away from the landing position of the main droplet is reduced and the deviation in the landing position of the main droplet is also reduced.

The sheets P subjected to printing by the printer 204 are conveyed by the conveyance mechanism (not illustrated) downstream of the conveyer 202 while being guided by the guide plates 221, 222 and are discharged.

Returning to FIG. 38, in step S4, the controller 205 determines whether printing based on the print job is completed. When the controller 205 determines that the printing based on the print job is not completed (step S4: NO), the controller 205 repeats step S4.

When the controller 205 determines that the printing based on the print job is completed (step S4: YES), the controller 205 terminates the series of operations.

Figure 42:
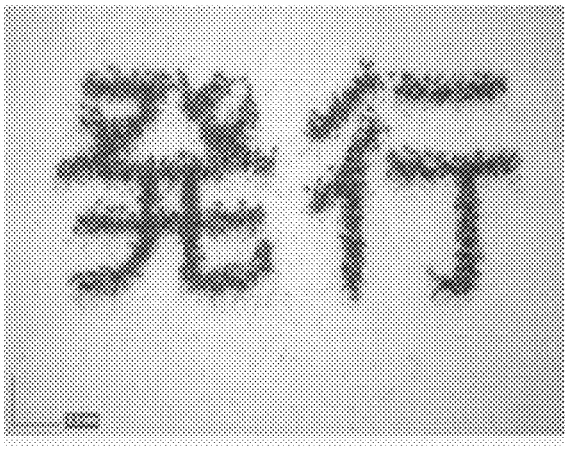
FIG. 42 is an example of a printed image according to the seventh embodiment.
Figure 43:
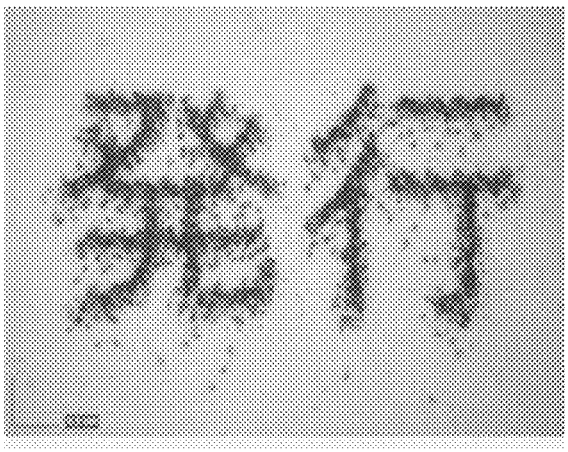
FIG. 43 is a view illustrating an example of a printed image in a comparative example.

FIG. 42 illustrates an example of an image printed in the aforementioned operations. Moreover, as a comparative example, FIG. 43 illustrates an example of an image printed when the fans 217 are controlled based on the first table 241 for all inkjet heads 236 without performing the ink temperature adjustment of maintaining the ink temperature at or above the specified temperature in each inkjet head 236 in which the maximum drop number is equal to or less than the threshold. The deviation of the ink landing positions in the example of FIG. 42 according to the seventh embodiment is smaller than that in the comparative example of FIG. 43.

As described above, in the inkjet printer 201, the controller 205 controls each fan 217 such that the lower the ink temperature in the inkjet head 236 is, the stronger the air flow in the under-head space 218 is. This can suppress the landing of relatively-large satellite droplets in a white portion of the sheet P when the ink temperature is relatively high, and also cause the air flow to blow away fine satellite droplets and prevent them from adhering to the sheet P when the ink temperature is relatively low.

Moreover, when the maximum drop number in each inkjet head 236 is equal to or less than the threshold, the controller 205 adjusts the ink temperature by using the temperature adjuster 232 such that the ink temperature is maintained at or above the specified temperature, and also controls the fan 217 such that the air flow in the under-head space 218 adjusted depending on the ink temperature is weaker than that in the case where the maximum drop number is more than the threshold. This can reduce the landing position deviation of the main droplet when the maximum drop number is equal to or less than the threshold, and also suppress the landing of relatively-large satellite droplets in a white portion of the sheet P.

Accordingly, the inkjet printer 201 can reduce the ink landing position deviation and also reduce mist smear on the printed sheet.

Note that, when the maximum drop number in the inkjet head 236 is equal to or less than the threshold, the controller 205 may perform the ink temperature adjustment of maintaining the ink temperature at or above the specified temperature and perform, as the control of the fan 217 corresponding to the ink temperature, the same control as that in the case where the maximum drop number is more than the threshold. Specifically, when the maximum drop number in the inkjet head 236 is equal to or less than the threshold, the controller 205 may perform the ink temperature adjustment of maintaining the ink temperature at or above the specified temperature and control the fan 217 by referring to the first table 241. Also in this case, the case where the air flow in the under-head space 218 is strong in the ejection of small drop numbers is reduced. Accordingly, it is possible to reduce the ink landing position deviation and reduce mist smear on the printed sheet.

Moreover, although the strength of the air flow in each under-head space 218 is adjusted by using the fan 217 for sucking the sheet P on the conveyer belt 211 in the seventh embodiment, the configuration for adjusting the strength of the air flow in the under-head space 218 is not limited to this. For example, the strength of air flow in each under-head space 218 may be adjusted by using a fan which sends air to the under-head space 218 and which is different from the fan 217 for sucking the sheet P on the conveyer belt 211.

Furthermore, although the case where the inkjet heads 236 are the multi-drop type inkjet heads are described in the seventh embodiment, the inkjet heads 236 may be inkjet heads of a type in which the ink ejection amount per pixel is adjusted by adjusting the size of one droplet.

Moreover, although the configuration including multiple inkjet heads 236 is described in the seventh embodiment, the configuration may include only one inkjet head 236.

The embodiments have, for example, the following configurations.

An inkjet printer includes: a conveyer configured to convey a print medium; an inkjet head configured to eject ink to the print medium conveyed by the conveyer; a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is. The controller is configured to control the flow adjuster such that the lower a temperature of the ink to be ejected by the inkjet head is, the stronger the air flow in the under-head space is.

The inkjet printer may further include a temperature adjuster configured to adjust the temperature of the ink in the inkjet head. The controller may be configured to: control the flow adjuster such that the lower the temperature of the ink in the inkjet head is, the stronger the air flow in the under-head space is; and control the temperature adjuster to maintain the temperature of the ink in the inkjet head at or above a prescribed temperature upon a maximum ejection amount of the ink per pixel in the inkjet head being equal to or less than a threshold.

The controller may be configured to control the flow adjuster such that the air flow in the under-head space adjusted depending on the temperature of the ink in a case where the maximum ejection amount is equal to or less than the threshold is weaker than that in a case where the maximum ejection amount is more than the threshold.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a conveyer configured to convey a print medium;

an inkjet head configured to eject ink to the print medium conveyed by the conveyer;

a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is, wherein the controller is configured to control the flow adjuster to strengthen the air flow in the under-head space depending on a physical property value of the ink including at least one of a temperature or a surface tension of the ink to be ejected by the inkjet head.

2. An inkjet printer comprising:

a conveyer configured to convey a print medium;

an inkjet head configured to eject ink to the print medium conveyed by the conveyer;

a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is, wherein the controller is configured to control the flow adjuster such that the lower a temperature of the ink to be ejected by the inkjet head is, the stronger the air flow in the under-head space is.

3. The inkjet printer according to claim 2, wherein the inkjet head includes a plurality of inkjet heads, the flow adjuster is configured to individually adjust strengths of the air flows in the under-head spaces of the respective inkjet heads, and for each of the inkjet heads, the controller is configured to control the flow adjuster such that the lower the temperature of the ink to be ejected by the inkjet head is, the stronger the air flow in the under-head space of the inkjet head is.

4. The inkjet printer according to claim 2, further comprising a temperature adjuster configured to adjust the temperature of the ink in the inkjet head, wherein the controller is configured to:

control the flow adjuster such that the lower the temperature of the ink in the inkjet head is, the stronger the air flow in the under-head space is; and control the temperature adjuster to maintain the temperature of the ink in the inkjet head at or above a prescribed temperature upon a maximum ejection amount of the ink per pixel in the inkjet head being equal to or less than a threshold.

5. The inkjet printer according to claim 4, wherein the controller is configured to control the flow adjuster such that the air flow in the under-head space is adjusted depending on the temperature of the ink so that the air flow is made weaker in a case where the maximum ejection amount is equal to or less than the threshold than that in a case where the maximum ejection amount is more than the threshold.

6. An inkjet printer comprising:

a conveyer configured to convey a print medium;

an inkjet head configured to eject ink to the print medium conveyed by the conveyer;

a flow adjuster configured to adjust strength of an air flow in an under-head space which is a space between the inkjet head and the conveyer; and a controller configured to control the flow adjuster such that the smaller a satellite droplet generated from the ink ejected by the inkjet head is, the stronger the air flow in the under-head space is, wherein the controller is configured to control the flow adjuster such that the lower a surface tension of the ink to be ejected by the inkjet head is, the stronger the air flow in the under-head space is.

7. The inkjet printer according to claim 6, wherein the inkjet head includes a plurality of inkjet heads, the flow adjuster is configured to individually adjust strengths of the air flows in the under-head spaces of the respective inkjet heads, and for each of the inkjet heads, the controller is configured to control the flow adjuster such that the lower the surface tension of the ink to be ejected by the inkjet head is, the stronger the air flow in the under-head space of the inkjet head is.

* * * * *